US007771376B2

(12) United States Patent
Roth et al.

(10) Patent No.: US 7,771,376 B2
(45) Date of Patent: Aug. 10, 2010

(54) INFLATABLE MASSAGE GARMENT

(75) Inventors: Rochelle B. Roth, Shaker Heights, OH (US); Brian Smith, Cleveland Heights, OH (US); William Brazis, Medina, OH (US); Roger H. Ramsey, Akron, OH (US)

(73) Assignee: Midtown Technology Ltd., Cleveland, OH (US)

( * ) Notice: Subject to any disclaimer, the term of this patent is extended or adjusted under 35 U.S.C. 154(b) by 933 days.

(21) Appl. No.: 11/339,813

(22) Filed: Jan. 25, 2006
(Under 37 CFR 1.47)

(65) Prior Publication Data

US 2007/0088239 A1 Apr. 19, 2007

Related U.S. Application Data

(63) Continuation-in-part of application No. 10/250,841, filed as application No. PCT/US02/00661 on Jan. 11, 2002, now abandoned, application No. 11/339,813, filed on Jan. 25, 2006, which is a continuation-in-part of application No. 09/586,307, filed on Jun. 2, 2000, now Pat. No. 7,044,924.

(60) Provisional application No. 60/261,700, filed on Jan. 12, 2001.

(51) Int. Cl.
*A61H 9/00* (2006.01)
*A61H 23/04* (2006.01)
*A61F 5/02* (2006.01)

(52) U.S. Cl. ..... 601/152; 602/13; 128/DIG. 20; 2/DIG. 3

(58) Field of Classification Search ..... 601/11, 601/148–152; 602/13; 128/DIG. 20; 2/DIG. 3
See application file for complete search history.

(56) References Cited

U.S. PATENT DOCUMENTS

| | | | |
|---|---|---|---|
| 1,608,239 | A | 11/1926 | Rosett |
| 2,361,242 | A | 10/1944 | Rosett |
| 2,528,843 | A | 11/1950 | Poor |
| 2,533,504 | A | 12/1950 | Poor |
| 2,781,041 | A | 2/1957 | Weinberg |

(Continued)

FOREIGN PATENT DOCUMENTS

| | | | |
|---|---|---|---|
| CA | 1133347 | A1 | 10/1982 |

(Continued)

*Primary Examiner*—Danton DeMille
(74) *Attorney, Agent, or Firm*—Hahn Loeser & Parks LLP

(57) ABSTRACT

A massage device for massaging a body part of a person in an unsupervised and unattended setting is provided. In a preferred embodiment, the massage device comprises an inflatable garment (200) having a plurality of inflation bladders (250), to apply pressure to the body part, and an inflation assembly (300) includes a manifold (324) into which the pressurized fluid flows, a plurality of inflation valves (326) which control the flow of fluid from the manifold to the bladders, and a manifold valve for controlling the maximum pressure level within the bladders. The inflation assembly may have a predetermined inflation capacity which defines a maximum bladder size as well as an array in which the bladders are arranged. The massage device may further comprise a connector for connecting tubes from the bladders to the inflation assembly, wherein the connector includes a garment-identifying component for identifying the type of garment connected to the inflation assembly.

3 Claims, 15 Drawing Sheets

U.S. PATENT DOCUMENTS 2,880,721 A 4/1959 Corcoran
2,893,382 A 7/1959 Demeny
3,177,866 A 4/1965 Wesslund
3,297,023 A 1/1967 Foley
3,411,496 A 11/1968 Strehler
3,521,623 A * 7/1970 Nichols et al. ..... 602/13
3,548,809 A 12/1970 Conti
3,659,593 A 5/1972 Vail
3,701,173 A 10/1972 Whitney
3,824,992 A 7/1974 Nicholson et al.
3,826,249 A 7/1974 Lee et al.
3,867,732 A 2/1975 Morrell et al.
3,885,554 A 5/1975 Rockwell et al.
3,888,242 A 6/1975 Harris et al.
3,920,006 A 11/1975 Lapidus et al.
3,993,053 A 11/1976 Grossan
4,013,069 A 3/1977 Hasty
4,029,087 A 6/1977 Dye et al.
4,030,488 A 6/1977 Hasty
4,054,129 A 10/1977 Byars et al.
4,156,425 A 5/1979 Arkans
4,198,961 A 4/1980 Arkans
4,202,325 A 5/1980 Villari et al.
4,207,875 A 6/1980 Arkans
4,207,876 A 6/1980 Annis
4,225,989 A 10/1980 Corbett et al.
4,231,355 A 11/1980 Hara
4,253,449 A 3/1981 Arkans et al.
4,267,611 A 5/1981 Agulnick
4,280,485 A 7/1981 Arkans
4,311,135 A 1/1982 Brueckner et al.
4,348,740 A 9/1982 White
4,374,518 A 2/1983 Villanueva
4,453,538 A 6/1984 Whitney
4,551,874 A 11/1985 Matsumura et al.
4,573,453 A 3/1986 Tissot
4,577,626 A 3/1986 Marukawa et al.
4,583,255 A 4/1986 Mogaki et al.
4,590,925 A 5/1986 Dillon
4,597,384 A 7/1986 Whitney
4,622,706 A 11/1986 Takeuchi
4,624,244 A 11/1986 Taheri
4,718,699 A 1/1988 Kulish et al.
4,722,332 A 2/1988 Saggers
4,762,121 A 8/1988 Shienfeld
4,809,684 A 3/1989 Gardner et al.
4,846,160 A 7/1989 Gardner et al.
4,865,020 A 9/1989 Bullard
4,938,208 A 7/1990 Dye
4,941,458 A 7/1990 Taheri
4,966,396 A 10/1990 Dye
4,989,589 A 2/1991 Pekanmaki et al.
5,007,411 A 4/1991 Dye
5,014,681 A 5/1991 Heeman et al.
5,022,387 A 6/1991 Hasty
5,031,604 A 7/1991 Dye
5,052,377 A 10/1991 Frajdenrajch
5,092,317 A 3/1992 Zelikovski
5,109,832 A 5/1992 Proctor et al.
5,117,812 A 6/1992 McWhorter
5,179,941 A 1/1993 Siemssen et al.
5,211,162 A 5/1993 Gillen et al.
5,233,974 A 8/1993 Senoue et al.
5,245,990 A 9/1993 Bertinin
5,263,473 A 11/1993 McWhorter
5,307,791 A 5/1994 Senoue et al.
5,329,640 A 7/1994 Hourigan
5,342,285 A 8/1994 Dye
5,383,842 A 1/1995 Bertini
5,391,141 A * 2/1995 Hamilton ..... 601/151
5,396,896 A 3/1995 Tumey et al.
5,403,265 A 4/1995 Berguer et al.
5,435,009 A 7/1995 Schild et al.
5,478,119 A 12/1995 Dye
5,569,170 A * 10/1996 Hansen ..... 601/150
5,575,762 A 11/1996 Peeler et al.
5,584,798 A 12/1996 Fox
5,588,954 A 12/1996 Ribando et al.
5,611,772 A 3/1997 Fujimoto et al.
5,626,556 A 5/1997 Tobler et al.
5,672,148 A 9/1997 Maunier
5,725,485 A 3/1998 Ribando et al.
5,762,618 A 6/1998 Yamanaka et al.
5,769,800 A 6/1998 Gelfand et al.
5,792,082 A 8/1998 Yamanaka et al.
5,795,312 A 8/1998 Dye
5,843,007 A 12/1998 McEwen et al.
5,876,359 A 3/1999 Bock et al.
5,931,797 A * 8/1999 Tumey et al. ..... 601/152
5,938,627 A 8/1999 Hickman
5,938,628 A 8/1999 Oguri et al.
5,951,502 A 9/1999 Peeler et al.
6,080,120 A 6/2000 Sandman et al.
6,123,681 A 9/2000 Brown
6,129,688 A 10/2000 Arkans
6,155,996 A 12/2000 Van Brunt et al.
6,159,172 A 12/2000 Gray et al.
6,171,270 B1 1/2001 Gau
6,179,796 B1 1/2001 Waldridge
6,179,797 B1 1/2001 Brotz
6,203,510 B1 3/2001 Takeuchi et al.
6,231,532 B1 5/2001 Watson et al.
6,254,556 B1 7/2001 Hansen et al.
6,267,739 B1 7/2001 Cengarle
6,273,866 B2 8/2001 Thomas et al.
6,290,662 B1 9/2001 Morris et al.
6,296,617 B1 10/2001 Peeler et al.
6,447,467 B1 9/2002 Barak
6,700,031 B1 * 3/2004 Hahn ..... 602/41
6,786,879 B1 9/2004 Bolam et al.
7,044,924 B1 5/2006 Roth et al.
2004/0054306 A1 3/2004 Roth et al.

FOREIGN PATENT DOCUMENTS

CA 2070031 A1 5/1996
DE 1903217 A1 4/1970
DE 2239331 A1 2/1973
EP 0 026 799 A1 4/1981
EP 0 129 481 A2 12/1984
EP 0 388 200 A2 9/1990
EP 0 392 669 A2 10/1990
EP 0 392 670 A2 10/1990
EP 0 542 383 A2 5/1993
FR 2 267 751 A1 11/1975
FR 2 371 914 A1 6/1978
FR 2 511 241 A1 2/1983
FR 2 583 978 A1 1/1987
GB 483111 A 4/1938
GB 483132 A 4/1938
GB 726154 A 3/1955
GB 1 234 238 A 6/1971
GB 1 531 268 A 11/1978
GB 2 068 737 A 8/1981
JP 5-49661 A 3/1955
SU 839534 A1 6/1981
SU 1412784 A1 7/1988
WO 0193797 A2 12/2001
WO 0193797 A3 5/2002
WO 02055005 A1 7/2002

* cited by examiner

INFLATABLE MASSAGE GARMENT

RELATED APPLICATION DATA

This application is a continuation-in-part of U.S. application Ser. No. 10/250,841, filed Jul. 8, 2003, now abandoned, which is a national stage application of PCT/US02/00661, filed Jan. 11, 2002, which claims the benefit of U.S. Provisional Application No. 60/261,700 under 35 U.S.C. §119(e), filed on Jan. 12, 2001, all of which are hereby incorporated herein by reference. This application is also a continuation-in part of U.S. application Ser. No. 09/586,307, filed Jun. 2, 2000, now U.S. Pat. No. 7,044,924, which is hereby incorporated herein by reference.

FIELD OF THE INVENTION

This invention relates generally as indicated to a massage device and more particularly to a massage device for use in an unsupervised and unattended setting.

BACKGROUND OF THE INVENTION

A massage has long been recognized as a pleasant means of treating stress, muscular aches, fatigue and other symptoms associated with an active life. A professional masseuse is typically employed to provide a massage and this professional is trained to provide pressure sensations by squeezing or kneading muscles or muscle groups in a certain way. Also, a professional masseuse will adapt the massaging technique to the person being massaged. For example, the masseuse will vary the time, intensity (i.e., pressure level), the order of pressure sensations and/or the temperature of massage oil to accommodate a person's massage needs on a particular day. Furthermore, the hands of the masseuse are adaptable to fit almost every size person.

A massage applied by a professional masseuse is almost universally considered wonderful. However, the cost of having a professional masseuse constantly on call for periodic massages is outside most people's budgets. For many, a massage by a professional masseuse is only an occasional indulgence although our active lives justify more frequent massages.

In the past, massaging devices have been developed for relaxation and leisure purposes. These massaging devices generally function in a vibratory manner to create a vibrating sensation on various muscles of the body. However, these vibratory devices are generally not as satisfying as a human massage because, among other reasons, they do not provide a comparable amount of pressure, and they often create an undesired tingling sensation on the user's skin.

Also in the past, compression devices have been developed for medical purposes. These prior art compression devices are generally used in a hospital setting where trained medical personnel are available to insure proper functioning of the device and a proper fit of the garments/sleeves on the patient. Such prior art compression devices use very large inflatable bladders which cover large areas of a limb, their control units are large and cumbersome, and they operate to provide a very slow massaging action (for example, on the order of tens of seconds to inflate each bladder) and thus do not provide a dynamic massaging effect. Additionally or alternatively, in such a medical setting, it may be practical to have an inventory of sleeves/garments of different sizes to accommodate a variety of patient sizes. Further, the size and appearance of inflation tubing and/or the complexity of the set-up of such tubing does not present any issues in a medical setting, where a trained medical professional is present or available. As for the inflation assembly, complicated and expensive fluid-providing and/or distributing components are common place in these prior art medical devices.

The inventor of the present invention appreciated that a relatively simple, inexpensive massage device intended for relaxation and other personal, non-medical uses in an unsupervised and unattended setting (such as in-home use) could have many advantages and applications. The inventor further appreciated, however, that many of the features of prior art compression devices which are acceptable in a supervised medical setting, would not be satisfactory in such an unsupervised and unattended setting.

SUMMARY OF THE INVENTION

The present invention provides a massage device for massaging a body part of a person in an unsupervised and unattended setting. In a preferred embodiment, the massage device comprises an inflatable garment having a plurality of inflation bladders to apply pressure to the body part, and an inflation assembly for providing pressurized fluid to the bladders, wherein the inflation assembly includes a manifold into which the pressurized fluid flows, and a plurality of inflation valves which control the flow of fluid from the manifold to the bladders. The inflation assembly may also include a manifold valve for controlling the maximum pressure level within the bladders. Furthermore, the inflation assembly may have a predetermined inflation capacity which defines a maximum bladder size as well as a predetermined array in which the bladders are arranged. The massage device may further comprise a connector for connecting tubes from the bladders to the inflation assembly, wherein the connector includes a garment-identifying component for identifying the type of garment connected to the inflation assembly.

DRAWINGS

DETAILED DESCRIPTION

Figure 1:
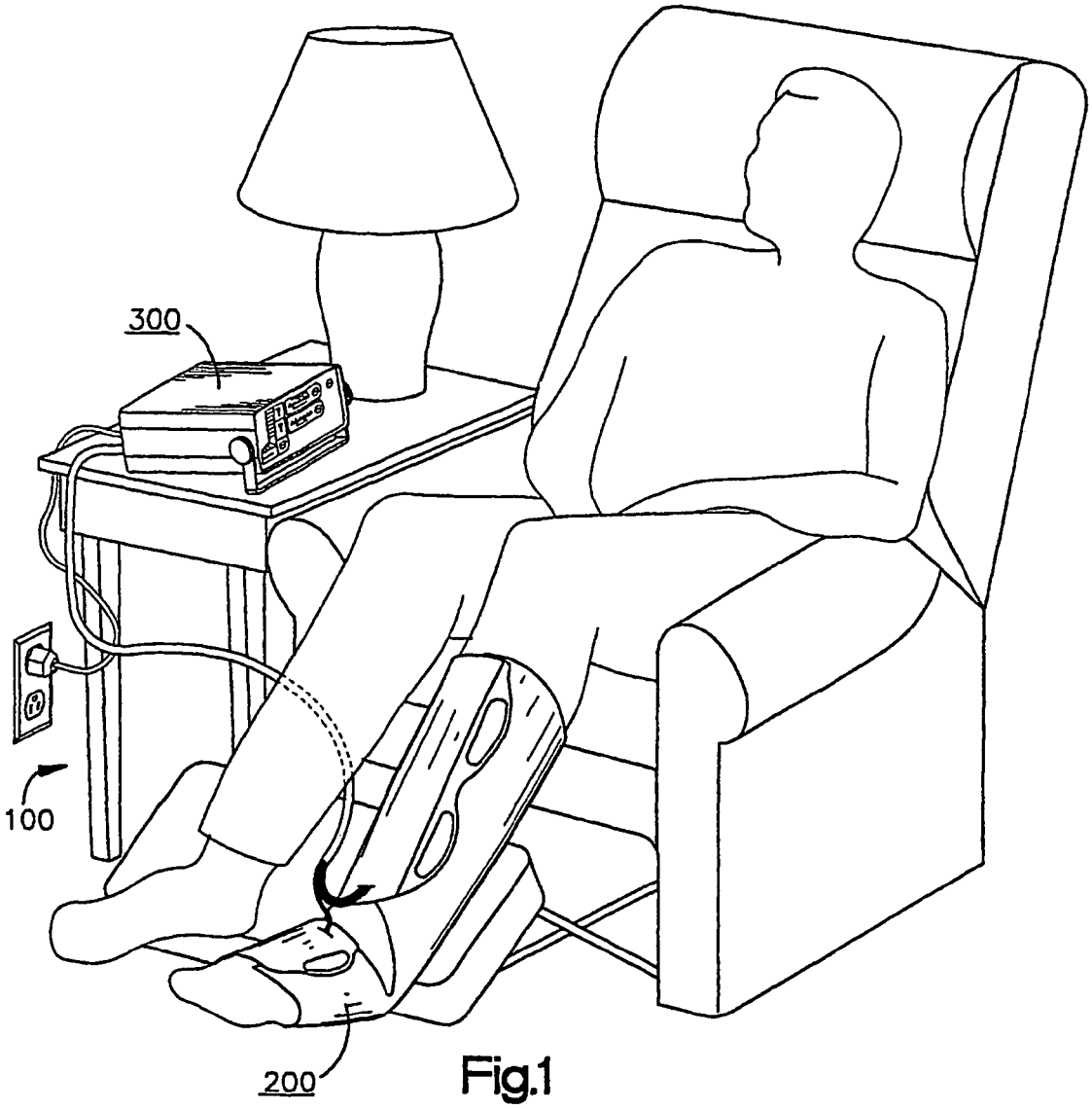
FIG. 1 is a prospective view of a massage device being used in an unsupervised and unattended setting according to the present invention.

Referring now to the drawings, and initially to FIG. 1, a massage device 100 according to a preferred embodiment of the present invention is shown in use in a setting which is unattended an unsupervised by a trained and/or medical personnel (referred to as "an unsupervised and unattended setting"). The massage device 100 may include an inflatable garment 200 for applying pressure to a body part and an inflation assembly 300 for supplying pressurized fluid to the inflatable garment 200. A preferred embodiment of an inflation assembly 300 is described below in detail with respect to FIGS. 3B-3D, two different embodiments of a foot/calf inflatable garment 200/200' are described below in detail with respect to FIGS. 2A-2C and FIG. 2J, respectively, and a preferred embodiment of a neck/shoulders inflatable garment 1200 is described below in detail with respect to FIG. 2K.

Figure 2A:
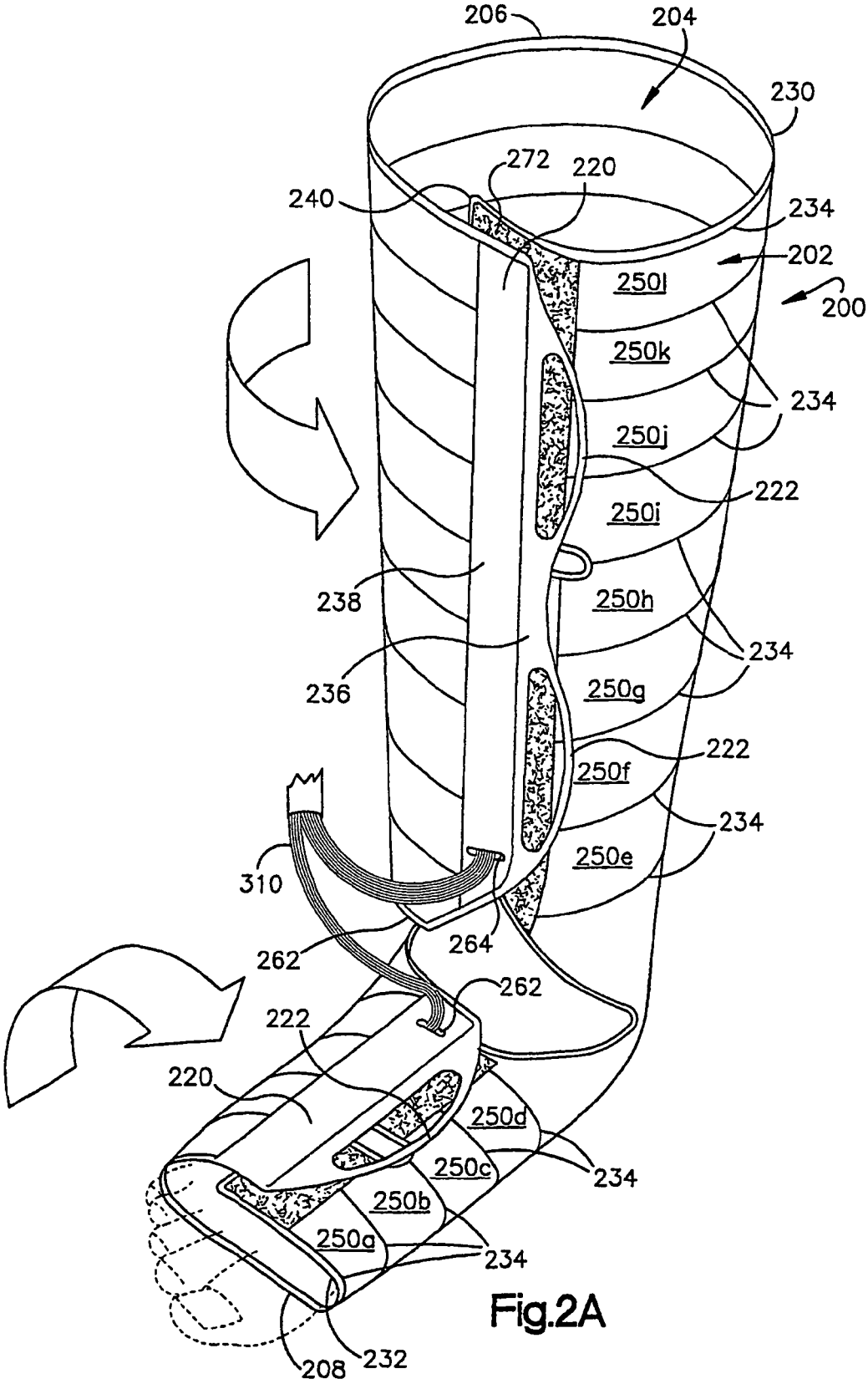
FIG. 2A is a prospective view of a foot/calf inflatable garment in a wrapped condition which may be used with the present invention.
Figure 2B:
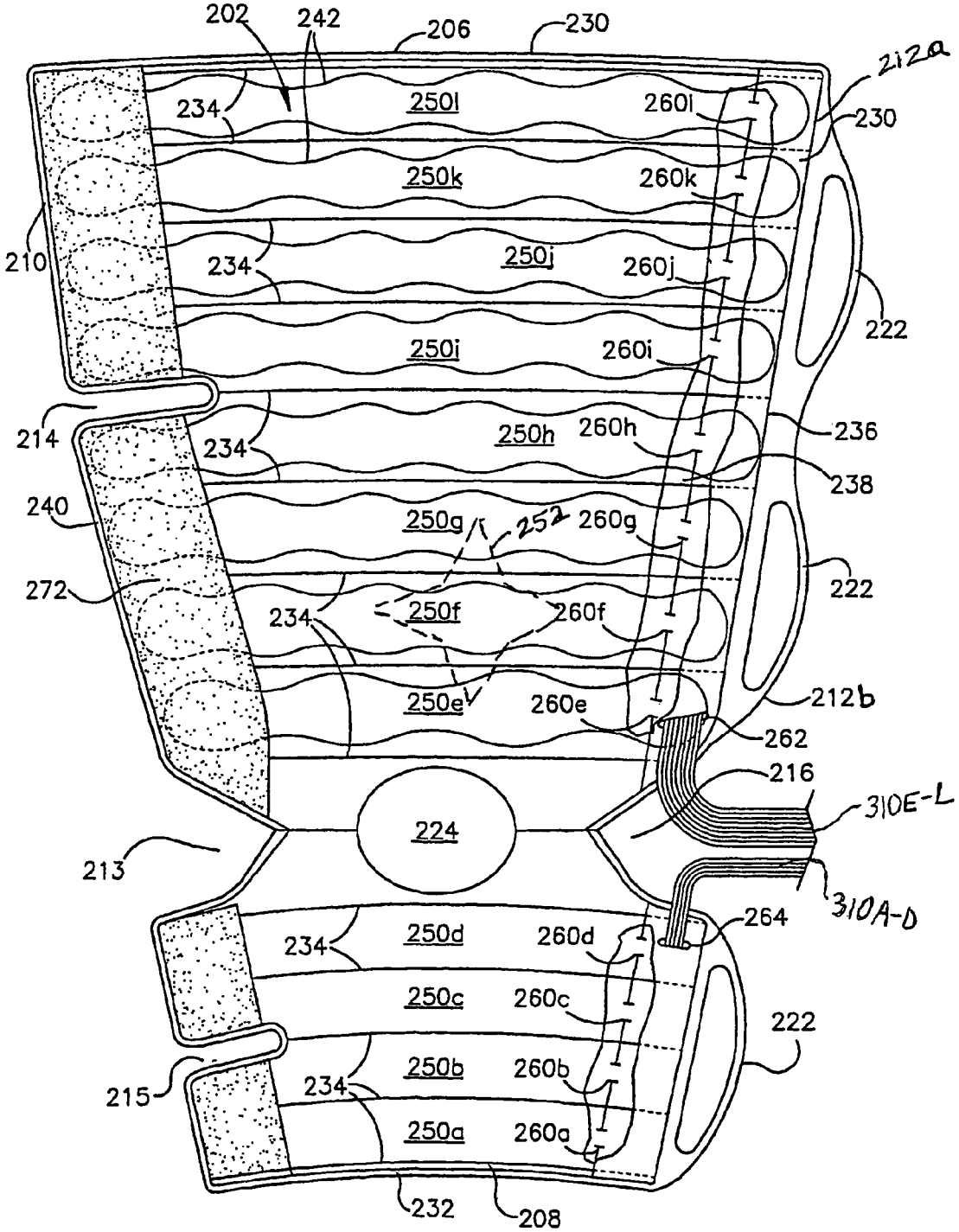
FIG. 2B is a partial breakaway plan view of the foot/calf inflatable garment of FIG. 2A in an unwrapped condition with its outer sheet face up.
Figure 2C:
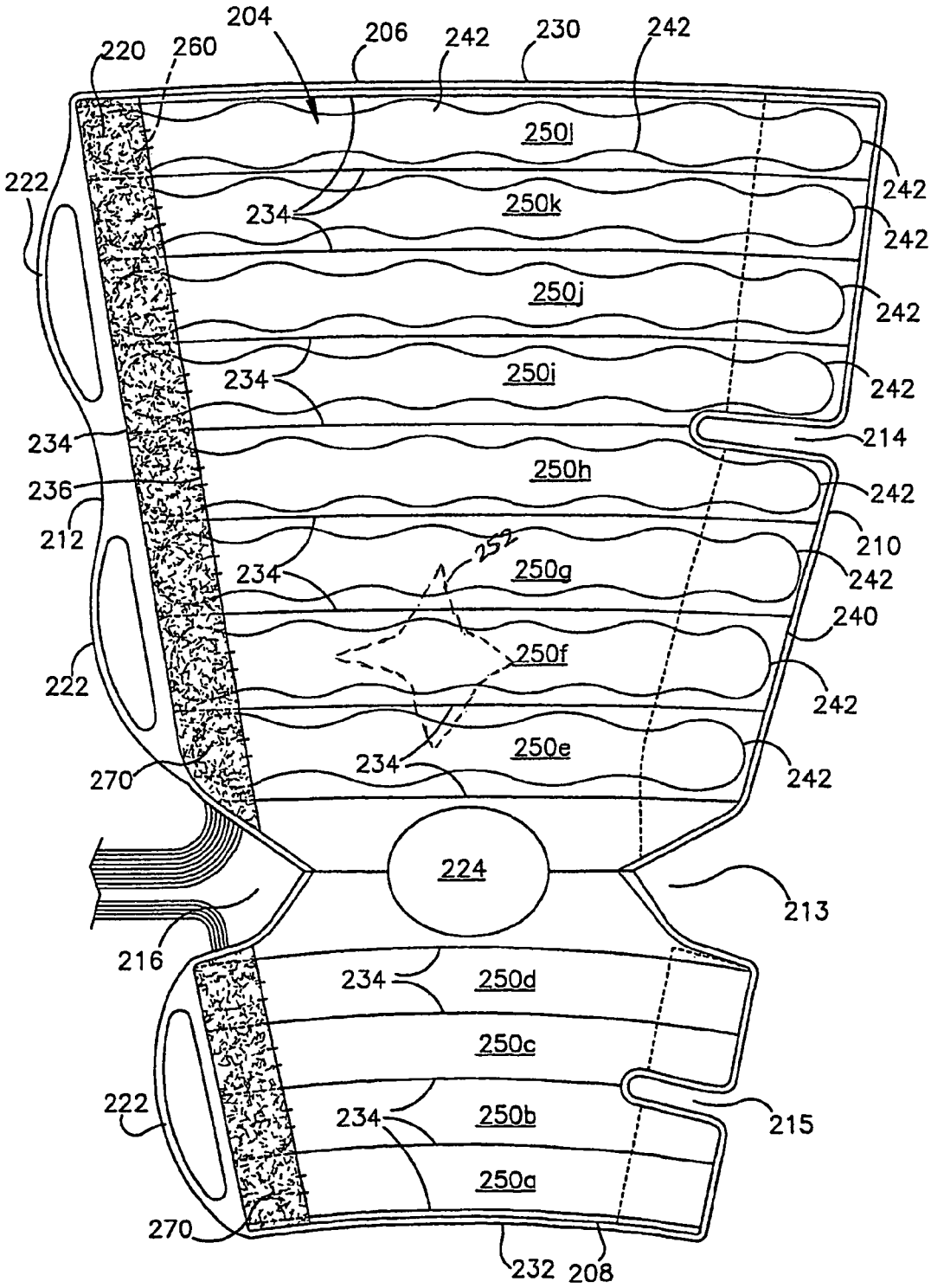
FIG. 2C is a plan view of the foot/calf inflatable garment of FIG. 2A in an unwrapped condition with its inner sheet face up.

Referring to FIGS. 2A-2C, a preferred embodiment of a foot/calf inflatable garment 200 for use in connection with the massage device 100 of FIG. 1 is shown. The inflatable garment 200 may comprise two opposing sheets 202 and 204 made of a suitable material, such as a material which is lightweight, durable, and easily cleanable with, for example, water and a mild cleanser. For example, the outer sheet 202 may be made of urethane film supported with a laminate of 70.times.100 denier nylon weave and the inner sheet 204 may be made of unsupported urethane film.

Each of the sheets 202/204 has lateral edges 206 and 208 and longitudinal edges 210 and 212. The lateral edges 206 and 208, may follow a generally straight or slightly curved path. The longitudinal edge 210 may follow a generally linear path which may further comprise one or more notches 213-215. For example, in a preferred embodiment, there may be a large notch 213 and two smaller notches 214 and 215. In one embodiment, the longitudinal edge 212 may also follow a generally linear path 212*a*. Alternatively, the longitudinal edge 212 may follow a contoured path 212*b* having pull handles 222 to assist a user in creating a snug fit. Furthermore, the linear path of the longitudinal edge 212 may have one or more notches 216. In a preferred embodiment, a tubing pocket 220 for concealing the inflation tubing may be located along longitudinal edge 212.

The sheets 202 and 204 may be welded together along outer lateral seams 230 and 232, and along outer longitudinal seams 236 and 240. In addition, the garments may be further welded along a plurality of bladder seams 234 to define a plurality of air chambers or bladders. In a preferred embodiment, the inflation volume of each of the bladders is very small (e.g., 180 cm.sup.3 or less). As explained below, the smaller the inflation volume of the bladders, the less fluid is needed to inflate the bladders. Thus, smaller, more flexible tubing and a smaller, less complex and less expensive air compressor (both discussed below) may be used.

In an embodiment where a tubing pocket 220 is located along, for example, longitudinal edge 212, an internal longitudinal seam 238 may be formed laterally inward from longitudinal seam 236, so as to form the tubing pocket 220. One of the outer lateral seams 230 is positioned along the sheets' top lateral edge 206 and the other outer lateral seam 232 is positioned along the sheets' bottom lateral edge 208. The bladder seams may be positioned along the length of the sheets 202/204 such that the bladder seams 234 are all substantially parallel to each other and to the outer lateral seams 230, 232.

Although not specifically shown in the drawings, reinforcement seams may be provided around the opening-defining edges of the pull handles 222, around the defining edges of a heel opening 224, and/or around the defining edges of the notches 213-216. In addition, a portion 252 of bladders 250E, 250F and/or 250G may be cut out to create a more snug fit when worn by a user.

As previously explained, the outer lateral seams 230, 232, bladder seams 234, and longitudinal seams 236 (or 238) and 240 form a plurality of inflatable bladders 250A-L, such that each bladder is in fluid isolation from its adjacent bladders. For example, as shown in the embodiment illustrated in FIGS. 2A-2C, the inflatable garment 200 may include twelve inflatable bladders 250A-250L, each of which may be substantially rectangular in shape, and arranged longitudinally along the length of the sheets 202/204. In this example, bladders 250A-250D correspond to the foot location, and bladders 250E-250L corresponds to the lower leg or calf location.

As indicated above, the bladders 250A-L are preferably each substantially rectangular in shape. In particular, the bladders 250A-L may be shaped such that they each have approximately equal inflated volumes, thereby equalizing both the inflation time and the inflation amount for the respective bladders. This may be accomplished by, for example, varying the spacing of the bladder seams 234. Alternatively, in a preferred embodiment, necking seams 242 may also be provided for inflation-control reasons as explained further below. Specifically, the necking seams 242 may be used to decrease the inflation volume of a bladder. This may be desirable where, for example, some un-necked bladders have a greater volume than other un-necked bladders of a given garment. The bladders 250 having necking seams 242 may have undulating contours such that these bladders are not substantially rectangular in shape. The undulating contours of the necking seams 242 function to decrease the inflation volume of the corresponding bladders 250. For example, in the illustrated embodiment, the top eight bladders circumscribing the user's calf 250E-250L may be provided with necking seams 242, while the lower bladders encircling the user's foot 250A-D remain un-necked. By providing substantially equal inflation volumes in each of the respective bladders 250A-L, substantially equal inflation timing, with substantially even applied pressure is provided. Thus, overall smooth massage dynamics may be provided without the need for overly complicated inflation fluid control.

Despite having the effect of changing a bladder's contour and/or inflation volume, the necking seams 242 do not apparently affect the massaging sensation provided by the necked bladders. For example, the necked shape of each of the bladders does not substantially change the original, overall, narrow and elongated shape of the un-necked bladder. Thus, substantially the same massage sensation is delivered as would have been delivered by the un-necked bladder.

As indicated above, a tubing pocket 220 may be provided to house, for example, inflation tubing 310 which, as explained below, supplies pressurized fluid to the bladders during operation of the massage device 100. The longitudinal seams 236 and 238 form the longitudinal sides of the tubing pocket 220, and the lateral seams 230 and 232 close the tubing pocket's top and bottom sides. A series of openings 260 may be created in the tubing pocket 220 so as to provide fluid communication between the compressor 320 and the respective bladders 250A-L.

A V-shaped slit 216 may be provided which interrupts the tubing pocket 220 at, for example, a location substantially aligned with the heel opening 224 of the inflatable garment 200. In a preferred embodiment, the individual tubes 310A-L are small (e.g., on the order of 2 mm in diameter), and thus are light weight and flexible. The small tubing is generally sufficient in a device according to the invention, especially where, as describe above, the inflation volume of each of the bladders is very small (e.g., 180 cm.sup.3 or less). The openings 260 allow the individual inflation tubes 310A-L to communicate with respective bladders 250A-L, and the slots 262 and 264 provide an entry passage for the inflation tubing 310 into the top and bottom portions of the tubing pocket 220. Although not specifically shown in the drawings, the inflation tubing 310 may be connected to the bladders via respective inflation access ports. The inflation access ports may provide, for example, push-on branches to which the individual inflation tubes 310A-L may be attached.

The foot/calf inflatable garment 200 may additionally include complimentary fastening strips 270 and 272 via which the garment may be fastened. For example, the fastening strips 270 and 272, when engaged with each other, may form a hook-and-loop attachment wherein the "loop" fastening strip 270 may be secured to the inner sheet 204 laterally inward from the pull handles 222 and over and laterally beyond the tubing pocket 220, while the "hook" fastening strip 272 is secured to the outer sheet 202 adjacent its longitudinal edge 210. In the alternative, the "hook" fastening strip 270 may be secured to the inner sheet 204 while the "loop" fastening strip 272 is secured to the outer sheet 202.

When using the massage device 100, the inflatable garment 200 is wrapped around a user's body part which, in the example disclosed in FIGS. 2A-2C, is the foot and calf region. Specifically, the person places his/her heel in the opening 224 and wraps the opposite lateral sections of the sheets 202/204 in the direction shown by the arrows in FIG. 2A. In an embodiment having pull handles 222, the pull handles 222 may be used to pull the strips 270 and 272 into the correct engaging contact with each other for a snug fit, and after a massage session is completed, the pull handles 222 are pulled outward to release the fastening strips 270 and 272.

The overall sheet geometry, the positioning of the fastening strips 270 and 272, the lateral extent of the fastening strips and/or other features of the garment 200 may allow for a snug "custom" fit of the inflatable garment 200 to the user. For example, an inflatable garment 200 according to an embodiment of the present invention may be fit to a wide range of foot widths and leg girths to accommodate users of different sizes. A very broad range of adjustment combinations are possible with the garment 200 instead of simply a single size or a large/medium/small adjustment setting. Thus, the inflatable garment's "one-size-fits-most" adjustable sizing design is beneficial for use of the massage device 100, especially in an unsupervised and unattended setting, such as in-home use where having a supply of multiple different sized garments is impractical. The ability of the inflatable garment 200 to provide a snug "custom" fit to a user may result in improved sensation, quicker inflation dynamics, reduced inflation flow requirements (thereby decreasing pump, valve, and tubing sizing requirements, and minimizing air flow requirements), compacted time lag from a deflated state to a maximum pressure state, and/or increased time at maximum massage pressure.

A snug "custom" fit of the inflatable garment 200 on a limb or body part will reduce the amount of inflation of the bladders 250 necessary to achieve the desired sensation. Furthermore, with a tighter fit and thus less inflation of the bladders 250, the inflatable garment 200 may not distort in size as much, thereby better maintaining the proper fit of the garment throughout the inflation process. This is because by virtue of the snug fit, the bladders 250 do not "balloon" away from the limb or body part in a third dimension during inflation. In this manner, there is little or no longitudinal "shrinking" of the garment (which would likely occur if the garment material had to move outward from the limb during inflation) hence maintaining a proper fit during the entire massage.

The inflatable garment 200 may include other or further features to facilitate comfort and/or massage characteristics. For example, padding may be provided on the inner surface of the tubing pocket 220 as a cushion between the inflation components housed in the tubing pocket 220 and the user's limb or body part being massaged. Additionally, non-slip grip elements may be placed on the outer sheet 202 on one or more portions of the inflatable garment 200. For example, with respect to the illustrated embodiment, non-slip grip elements may be placed on the outer sheet 202 beneath the user's foot, so that the user may walk around with the inflatable garment 200 on without slipping. Further, various sized holes may be incorporated into the inflatable garment 200 so as to allow for ventilation of the limb or body part wearing the garment. Still further, a moisture-wicking lining material may be applied to the surface of the inner sheet 204 for comfort against perspiration.

Figure 2D:
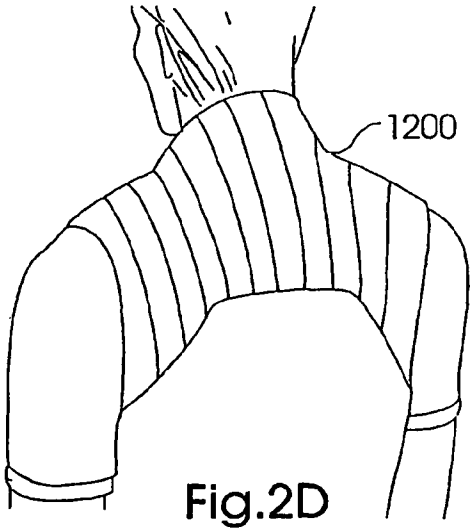
FIGS. 2D-2I are perspective views showing other inflatable garments that may be included in a massage device according to the present invention.
Figure 2E:
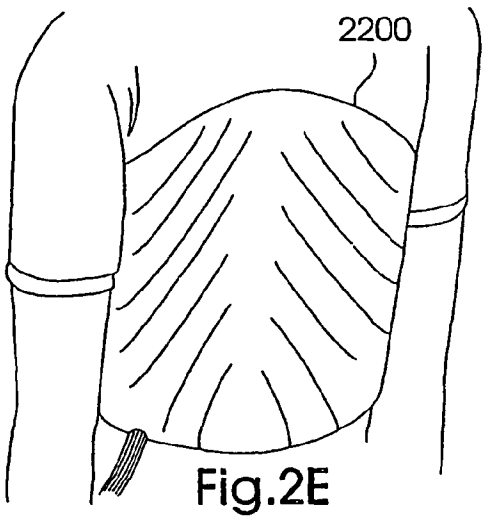
Figure 2F:
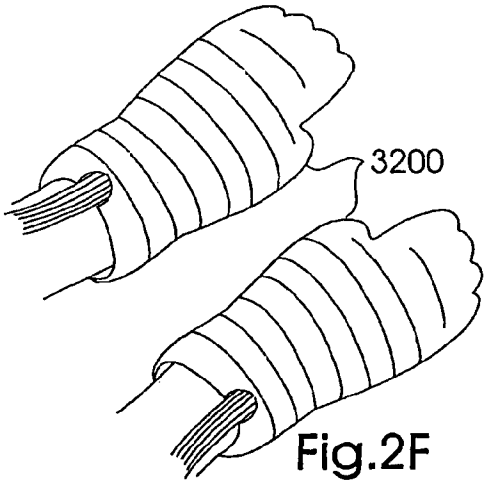
Figure 2G:
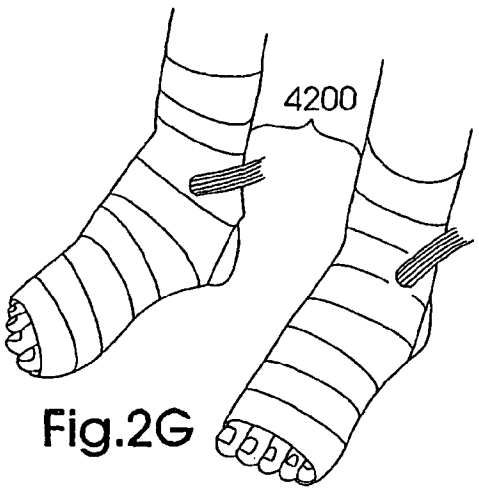
Figure 2H:
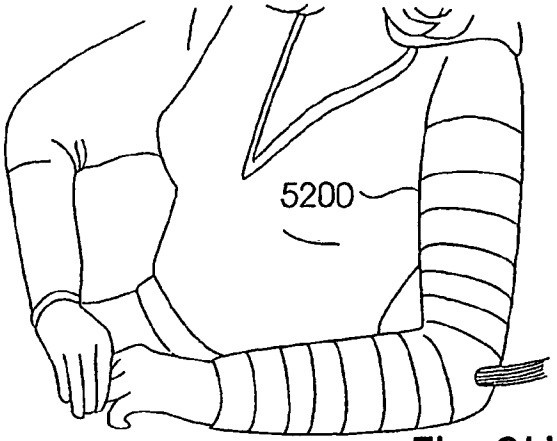
Figure 2I:
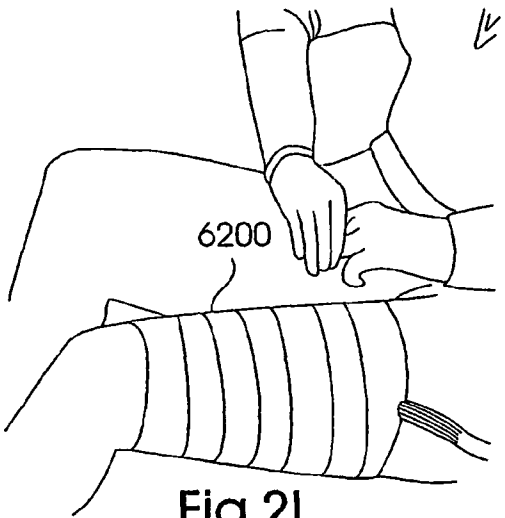

As previously explained, although the illustrated inflatable garment 200 is designed for use on a person's foot and calf, alternate garments are possible with, and contemplated by, the present invention. Other alternative inflatable garments are illustrated in FIGS. 2D-2I. For example, a neck/shoulder garment 1200 is shown in FIG. 2D, a back garment 2200 is shown in FIG. 2E, hand garments 3200 are shown in FIG. 2F, feet garments 4200 are shown in FIG. 2G, an arm garment 5200 is shown in FIG. 2H, and a thigh garment 6200 is shown in FIG. 2I. These and other inflatable garments may be designed in a manner similar to that described with respect to FIGS. 2A-2C to provide a snug "custom" fit for the respective body parts. Additionally, multiple garments may be used in combination, for example both hand garments together, or the leg and thigh garments together.

Figure 2J:
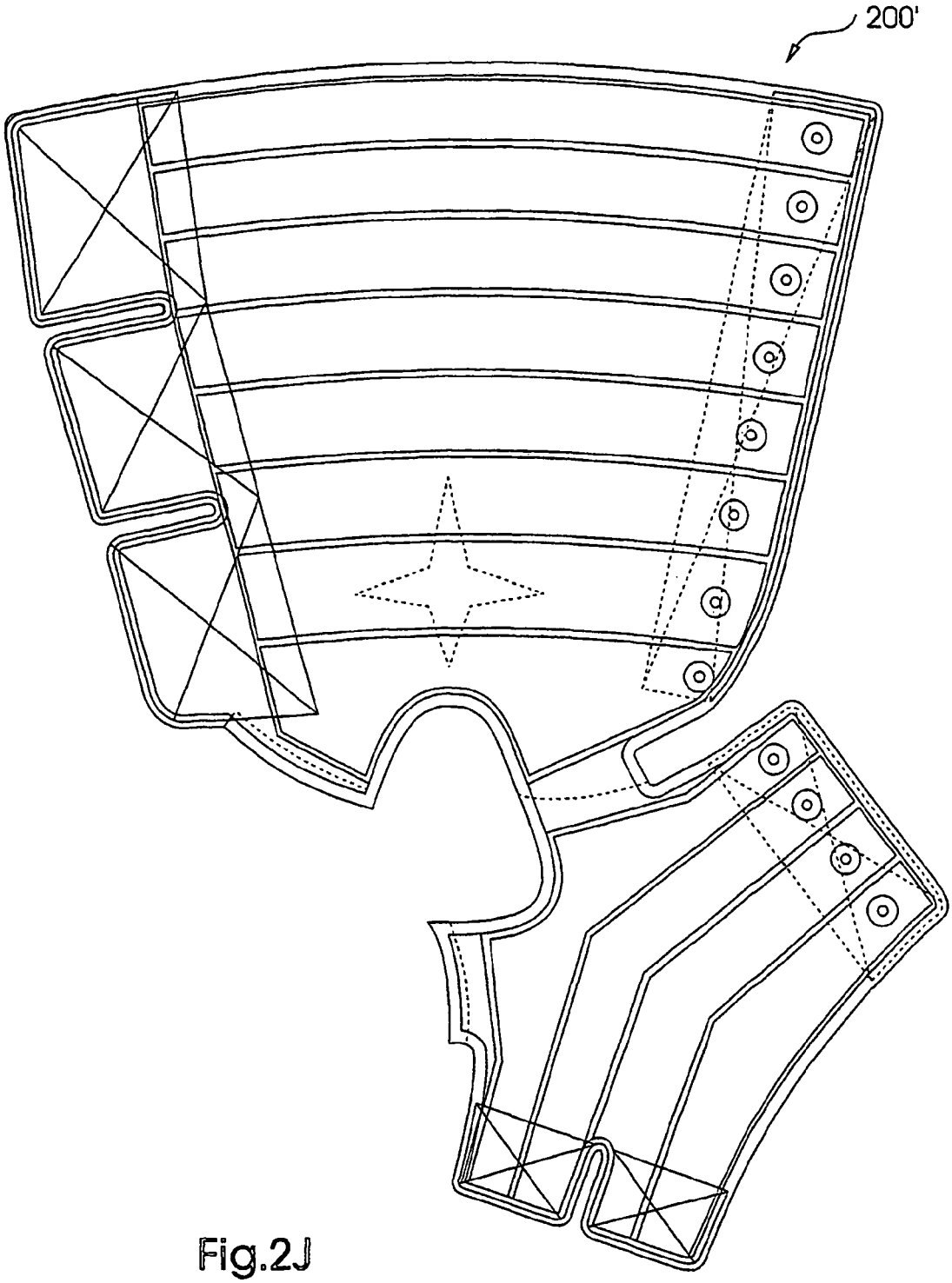
FIG. 2J is a plan view of an alternatively shaped foot/calf inflatable garment in an unwrapped condition with its inner sheet face up, which may be used in accordance with the present invention.

FIG. 2J illustrates an alternatively shaped embodiment of a foot/calf inflatable garment 200' for use in connection with the massage device 100 of FIG. 1. The primary distinction between the foot/calf inflatable garment 200 of FIGS. 2A-2C and the foot/calf inflatable garment 200' of FIG. 2J is the shape of the contours of the respective garments when laid out flat in an unwrapped condition. All of the other details and features of the alternatively shaped foot/leg garment 200' of FIG. 2J are substantially the same as those discussed with respect to FIGS. 2A-2C. The alternative shape may be more cost-effective to produce, and may provide a better fit for a wider range of leg sizes. FIG. 2J also illustrates that the present invention is not limited to the exact shaped garments illustrated in the figures. Rather, the shape of the various garments may be modified and still be within the scope of the present invention.

Figure 2K:
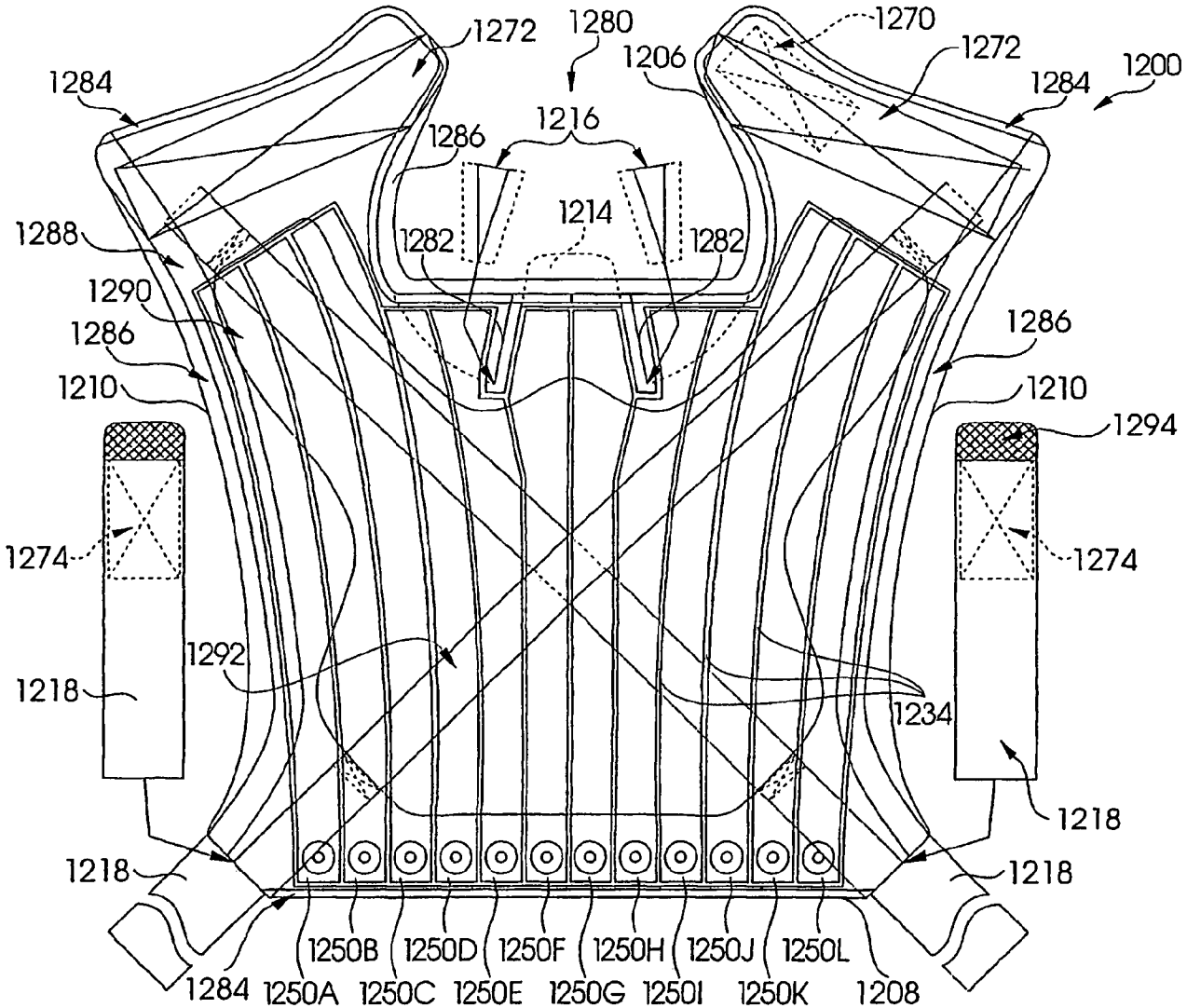
FIG. 2K is a plan view of the back/shoulders inflatable garment shown in FIG. 2D, the garment being shown in an unwrapped position.

Referring now to FIG. 2K, an embodiment of a neck/shoulder inflatable garment 1200 is shown in detail. Like the foot/calf inflatable garment 200 described with respect to FIGS. 2A-2C, the neck/shoulder inflatable garment 1200 may comprise two opposing sheets made of a suitable material, such as a material which is lightweight, durable, and easily cleanable with water and a mild cleanser. Each of the sheets has lateral edges 1206 and 1208 and longitudinal edges 1210. The top lateral edge 1206 may form a central opening 1280 to accommodate a user's neck. In one embodiment, a tab 1214 may be formed in the central opening for further support and/or massaging on the neck region. Inserts 1216 may be sewn to either the tab 1214 or to notched areas 1282 in the central opening 1280 to form a raised neckline or some other comfortable transition along the neckline. In a preferred embodiment, these inserts 1216 may be in the shape of right triangles with a curved hypotenuse, or equilateral triangles. However, any shape which provides a raised neckline or some other transition along the neckline may be used.

Furthermore, bias tape 1284 may be used to form the top and/or bottom lateral edge 1206, 1208, and felt or some other soft material 1286 may be used along the longitudinal edges 1210 and/or along the contour of the central opening 1280 for a more comfortable feel against the user's skin. In addition, the longitudinal edges 1210 and/or the top and/or bottom lateral edges 1206, 1208 may be formed of elastic strips 1288. The bottom lateral edge 1208 may follow a generally straight path ending at extension tabs 1218. The extension tabs 1218, which may be elastic, may be attached to, and/or extend from, each of the lower corners between the bottom lateral edge 1208 and the longitudinal edges 1210.

In a preferred embodiment of the neck/shoulders inflatable garment 1200, the garment 1200 may comprise a pressure plate 1290 to enhance the amount of pressure provided by the massage. The pressure plate 1290 may be desirable in the neck/shoulder inflatable garment 1200 because this garment 1200 (and any other similarly configured garment) generally does not wrap entirely around a limb or body part, and so may not benefit from the mechanical advantage of higher applied massage pressure that wrapping provides. The pressure plate 1290, which may be made of a polyurethane sheet, is generally shaped to contour the upper back/shoulder region, and may be adhered (either bonded or tied down) to either of the opposing sheets which make up the inflation bladders 1250A-J. Additionally, hold-down straps 1292 may be provided to assist in holding the pressure plate 1290 in place. The pressure plate 1290 and straps 1292 may be concealed by an opaque material (e.g., nylon) so as to provide a neat and clean appearance.

Bladder seams 1234 in the neck/shoulder inflatable garment 1200 may form a plurality of inflatable bladders 1250A-1250L which are each roughly rectangular in shape, arranged substantially parallel to each other, and extend roughly from the bottom to the top of the neck/shoulder inflatable garment 1200. In the illustrated embodiment, the four center bladders 1250E-H may be less rectangularly shaped (as shown) than the other bladders so as to better accommodate the neck, the notched areas 1282, and/or the inserts 1216. As with the bladders 250A-L of FIGS. 2A-2C, the bladders 1250A-L of FIG. 2K may be particularly shaped and/or necked so that they each have an approximately equal inflated volume, thereby equalizing both the inflation time and the inflation amount for the respective bladders. Also, while not specifically shown in FIG. 2K, the garment 1200 can have a tubing pocket (as described with respect to FIGS. 2A-2C) along, for example, its lower lateral edge to house certain components of the inflation assembly 300, such as, for example, inflation tubing 310 which, as previously described, may be provided to supply pressurized fluid to the bladders during operation of the massage device 100.

The neck/shoulder inflatable garment 1200 may additionally include fastening strips such as, for example, at least one pair of hook-and-loop strips. In one embodiment, a "loop" fastening strip 1270 may be secured to the inner sheet at one of the top corners of the central opening 1280 while a corresponding "hook" fastening strip 1272 is secured to the outer sheet at the other top corner of the central opening 1280. In one embodiment, "hook" fastening strips 1272 may be secured to the outer sheet at both corners of the central opening 1280. In addition, two further "loop" fastening strips 1274 may be attached to the inner side of each of the extension tabs 1218 which may be attached to the "hook" fastening strips 1272 is attached to the outer sheet at each of its two top corners. In an alternative embodiment, the "loop" strips and the "hook" strips may be reversed.

When in use, the neck/shoulder inflatable garment 1200 may be secured by placing the user's neck into the central opening, and engaging the fastening strips 1270 and 1272 under the user's chin. Also, the extension tabs 1218 may be pulled upward toward the user's shoulder and engaged with the appropriate strip such that strips 1274 are engaged with strips 1272. In one embodiment of the invention, extension tabs 1218 may include grip portions 1294 at the distal end of the extension tabs 1218 to make it easier for a user to grip the tabs 1218 and pull them toward strips 1272.

The overall geometry, the positioning of the fastening strips 1270, 1272 and 1274, the elastic longitudinal edges 1210, the inserts 1216, the extension tabs 1218, and/or other features of the neck/shoulder inflatable garment 1200 may provide for a snug "custom" fit of the garment 1200 to the user. For example, the garment 1200 according to an embodiment of the invention may be fit to a wide range of shoulder widths and chest girths to accommodate users of different sizes. A very broad range of adjustment combinations are possible with the neck/shoulder inflatable garment 1200 instead of simply a single size or large/medium/small adjustment setting. Thus, the garment's "one-size-fits-most" adjustable sizing design is beneficial for use of the massage device 100, especially in an unsupervised and unattended setting, such as in-home use where having a supply of multiple different sized garments is impractical. The ability of the inflatable garment 1200 to provide a snug "custom" fit to a user may result in improved sensation, quicker inflation dynamics, reduced inflation flow requirements (thereby decreasing pump, valve, and tubing sizing requirements, and minimizing air flow requirements), compacted time lag from a deflated state to a maximum pressure state, and/or increased time at maximum massage pressure.

Figure 3A:
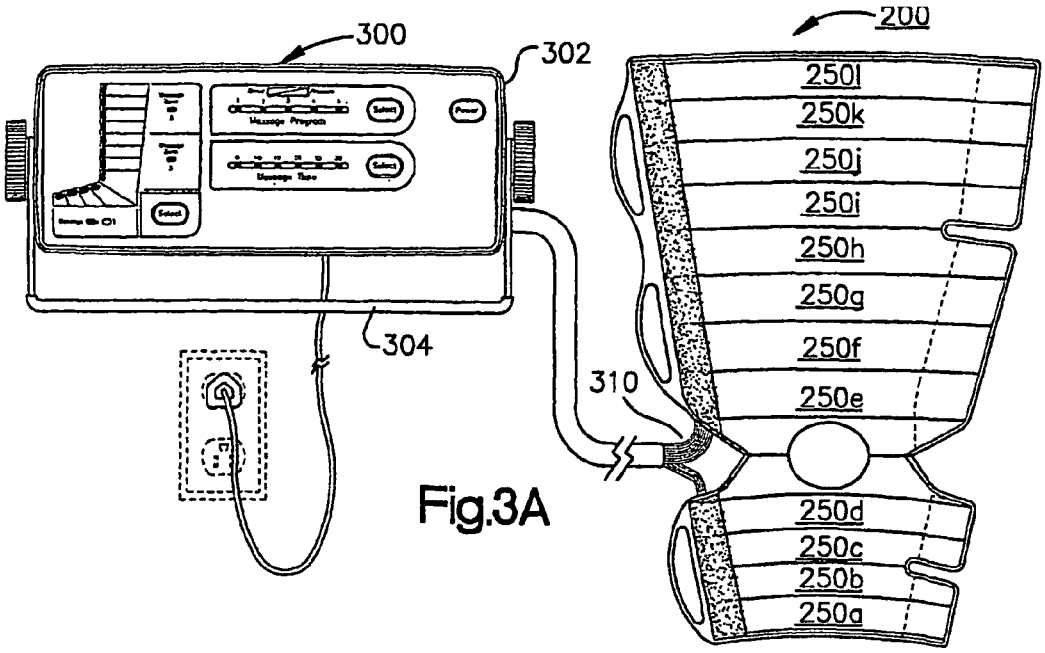
FIG. 3A is a schematic view of an inflatable garment and inflation assembly which may be used in connection with the present invention.

Referring now to FIG. 3A, an inflation assembly 300 for use in connection with the present invention is shown connected to an inflatable garment 200 via inflation tubing 310. The components of the inflation assembly 300 may be contained within a housing 302 which is preferably sized and shaped to be compatible with in-home use of the massage device 100. Inflation tubing 310 extends from the inflation assembly 300 to the garment 200 and, is preferably comprised of a plurality of individual tubes (310A-310L in FIG. 3B), each of which is connected to a corresponding bladder opening 260A-260L for supplying pressurized fluid to a corresponding bladder during operation of the massage device 100. Preferably, a connector 311 is provided at the distal end of the inflation tubing 310 for easy coupling to a mating portion of the inflation assembly 300. As explained in more detail below, the connector 311 and the mating portion of the inflation assembly 300 may be designed to accommodate the inflation tubing 310 as well as identifier posts which act to recognize the particular inflatable garment being used upon insertion of the connector 311 to the mating portion of the inflation assembly 300.

As illustrated in FIGS. 2B and 2J, with respect to the foot/calf inflatable garment 200, the tubes 310A-310D extend into the lower portion of the tubing pocket 220 and the tubes 310E-310L extend into the upper portion of the tubing pocket 220. The enclosure of the inflation tubing 310 in such a tubing pocket 220, provides a neat and organized appearance compatible with in-home use of the massage device 100. Also, the enclosure and the pre-purchase setup of the inflation tubing 310 eliminates any what-tube-where confusion during in-home installation and use of the massage device 100.

Figure 3B:
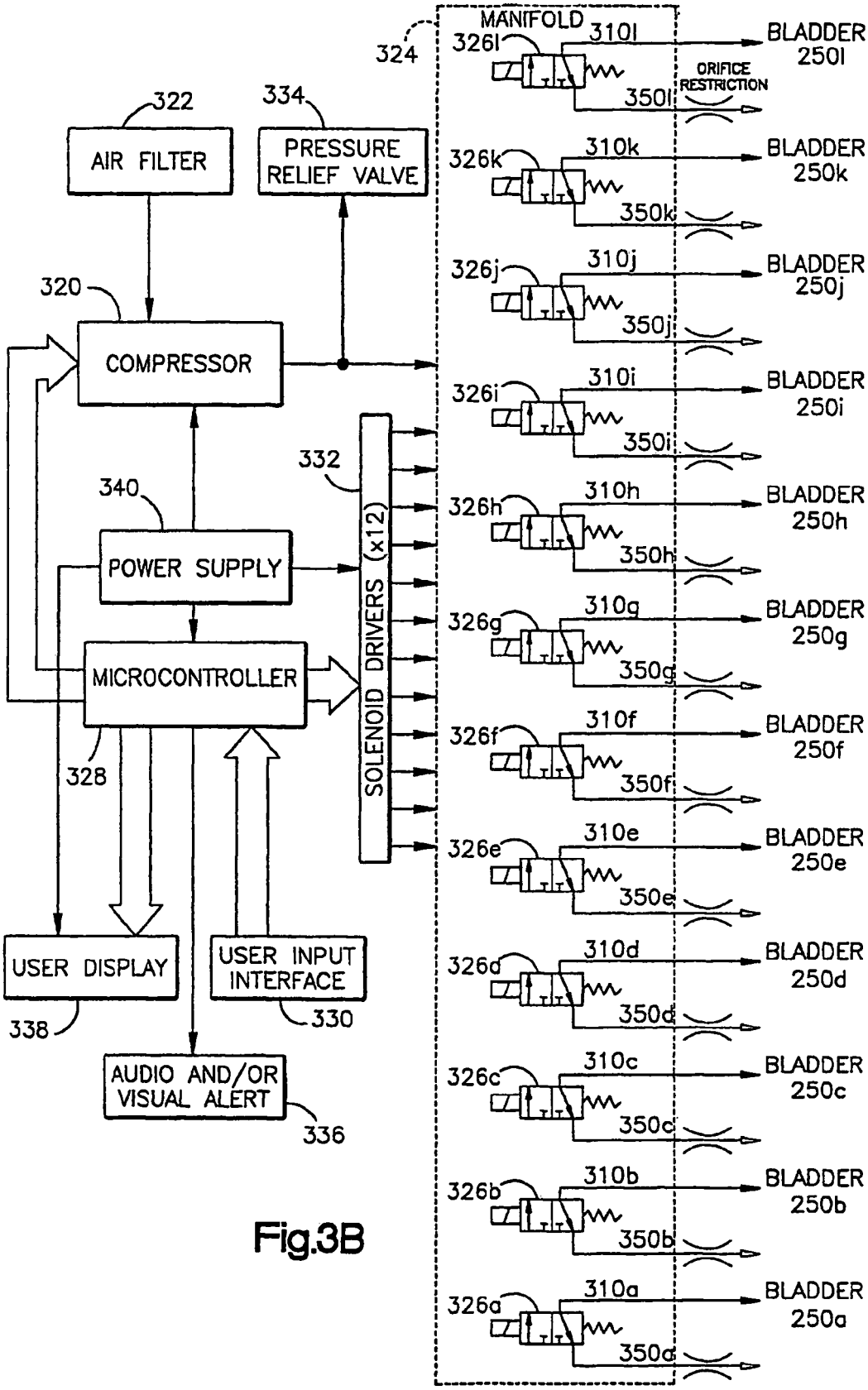
FIG. 3B is a block schematic view of an inflation assembly for use in connection with the present invention.
Figure 3C:
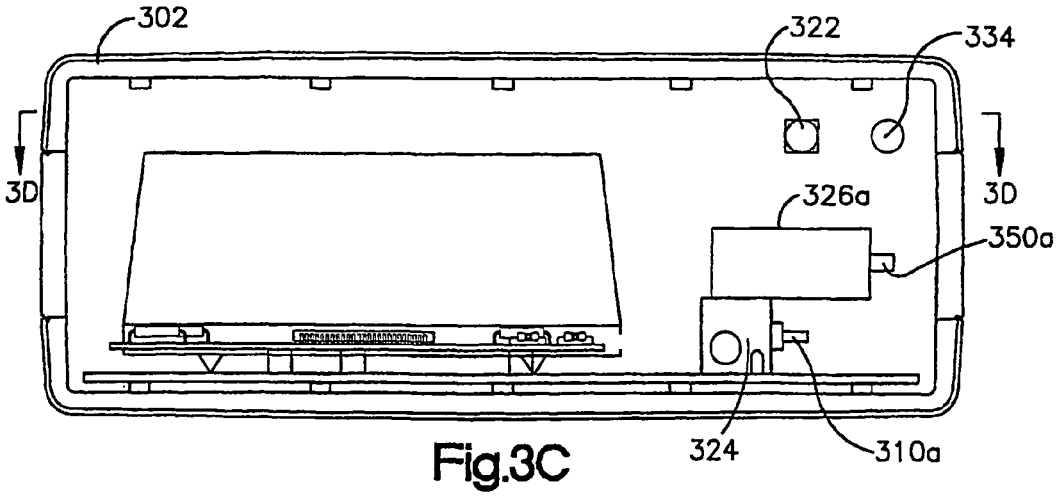
FIG. 3C is a front view of the inflation assembly of FIG. 5B with its display panel removed to show interior components.
Figure 3D:
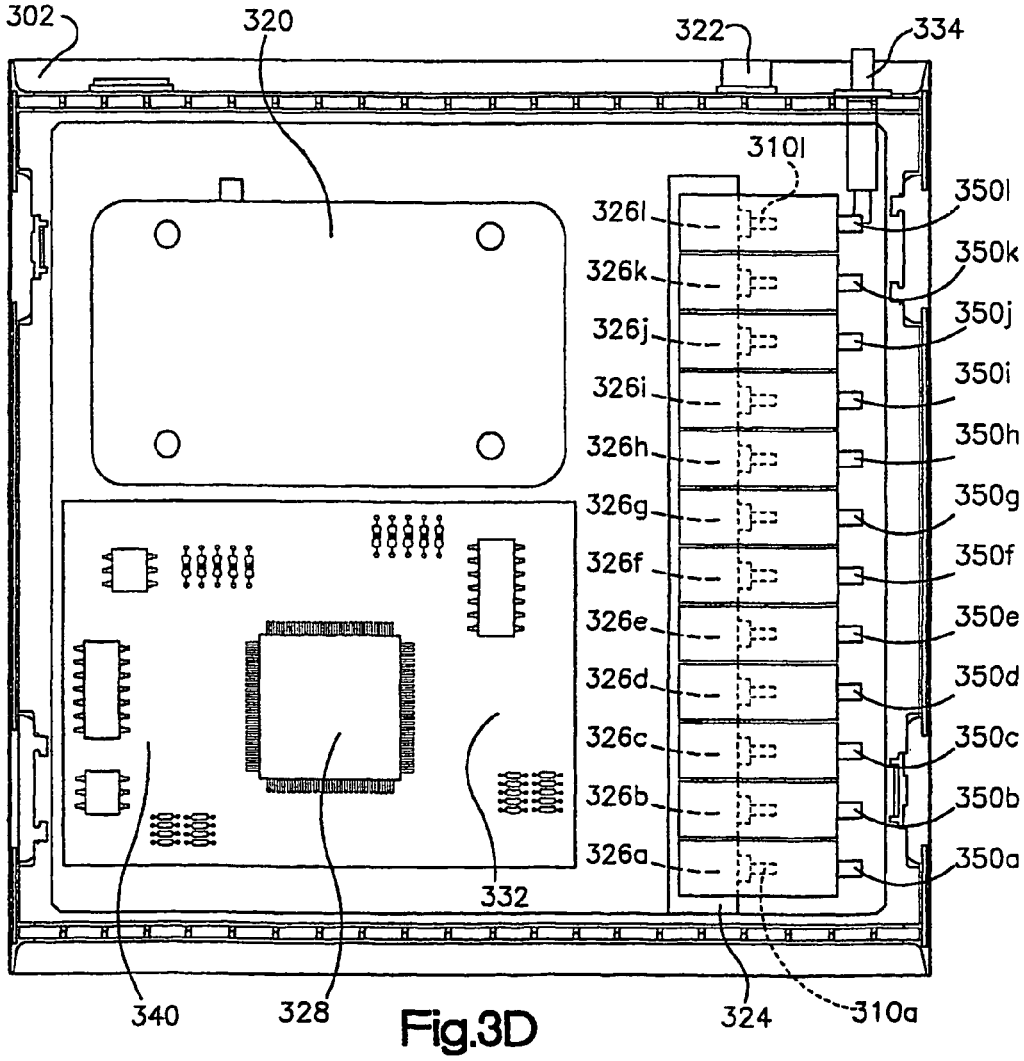
FIG. 3D is a top view of the inflation assembly of FIG. 3B with the top wall of its housing removed to show interior components.

As shown in FIGS. 3B-3D, the inflation assembly 300 may include a compressor 320, an air filter 322 (when air is used as the pressurizing medium), a manifold 324, inflation valves 326A-326L, a microcontroller 328 which may further comprise a memory unit (not shown), a user input interface 330 (described in detail with respect to FIG. 3E), valve drivers 332, a pressure relief valve 334, audio and/or visual alert 336, a display panel 338, and/or a power supply 340 for providing power to relevant components.

The compressor 320, which may be activated upon turning the inflation assembly 200 on, or by pressing a key on the display, provides fluid to the manifold 324 which in turn provides fluid to the bladders. The compressor 320 may preferably be driven by a simple conventional motor (not shown) at constant full speed, and the air filter 322 may also be a simple conventional air filter. The inflation valves 326A-L may be standard solenoid valves which control the flow of fluid into and out of the respective bladders. The pressure relief valve 334 may be included to limit the maximum pressure that can be developed and thus delivered to the inflatable garment 200. To this end, the valve 334 is preferably inaccessible to the user and/or tamper proof In one embodiment, the pressure relief valve 334 stops air from flowing into the manifold 324 once the pressure in the manifold 324 reaches 250 mm of Hg.

The microcontroller 328 is generally the "brains" of the control unit, and may comprise a memory storage unit for storing and recalling user preference settings, for one or more users (discussed further below). The microcontroller 328 may be a standard self-contained chip having program memory and LCD driver capability built-in, such as, for example, a Holtek HT49R50. The power supply 340 is generally a standard 120 V home power line. In addition or alternatively, the power supply 340 may comprise a battery. The audio and/or visual alert 336 may be, for example, a light source (such as a light-emitting diode) and/or an audio tone, and may be employed to alert the user of an event such as, for example, the end of a massage session.

In one embodiment of the present invention, during operation of the massage device 100, the compressor 320 provides a flow of inflation fluid (e.g., air filtered through the filter 322) to the manifold 324. The valve drivers 332 open and close the solenoid valves 326 based on signals from the microcontroller 328, so that the fluid within the manifold flows through the appropriate valve and to the appropriate bladder 250 in the garment 200. The valve drivers 332 may be, for example, a standard discrete design using a NPN/PNP transistor pair driven from the microcontroller 328. In a preferred embodiment, the valves 326 are solenoid valves whereby the drivers 332 activate and deactivate the solenoids.

The compressor 320 of the inflation assembly 300 may be one which provides a substantially constant inflation capacity to each of the bladders. As explained above, a substantially constant velocity and magnitude pressure wave along the inflatable garment 200 may be accomplished by varying the geometry of and/or necking the bladders 250. By providing uniform inflation characteristics of the bladders 250 with a substantially constant inflation capacity, a more uniform, repeatable, predictable, and satisfying massage action may be obtained. Further, due at least in part to the simplicity of such operation, more economical, more compact, and/or more reliable inflation components may be used.

During inflation of the garment bladders 250, inflation fluid flows through the inflation tubing 310 to the appropriate bladders 250A-L via corresponding inflation tubes 31A-L. During deflation of the garment bladders 250, the inflation fluid flows through the inflation tubing 310 in the reverse direction and through exhaust fines 350A-L. In one embodiment, the exhaust lines 350A-L may include a throttling device (such as the illustrated orifice restriction) through which fluid may flow during deflation of bladders, to provide a repeatable and gradual deflation rate for the bladders. If desired, and/or to increase uniformity, the throttling rate (or orifice size in the illustrated embodiment) may be the same for each bladder or may vary between respective bladders.

Figure 4A:
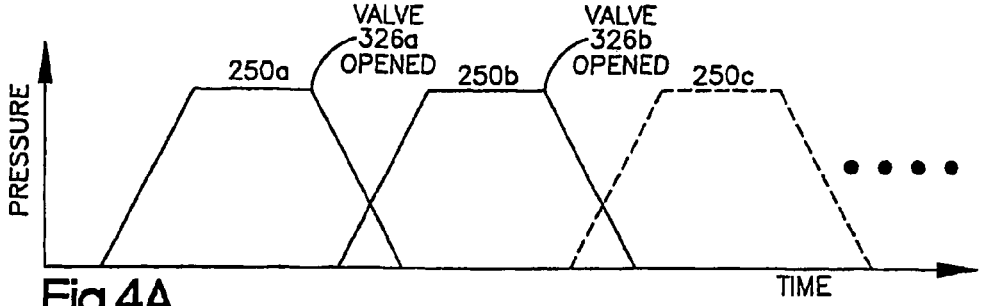
FIGS. 4A-4G are graphs showing various methods of sequential inflation of garment bladders in accordance with the invention
Figure 4B:
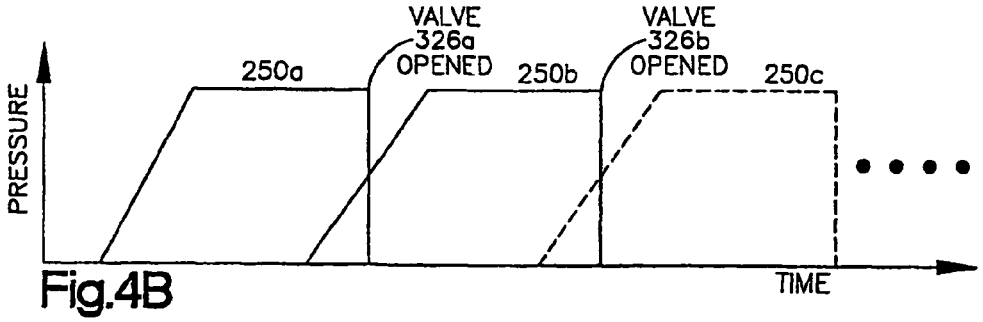
Figure 4C:
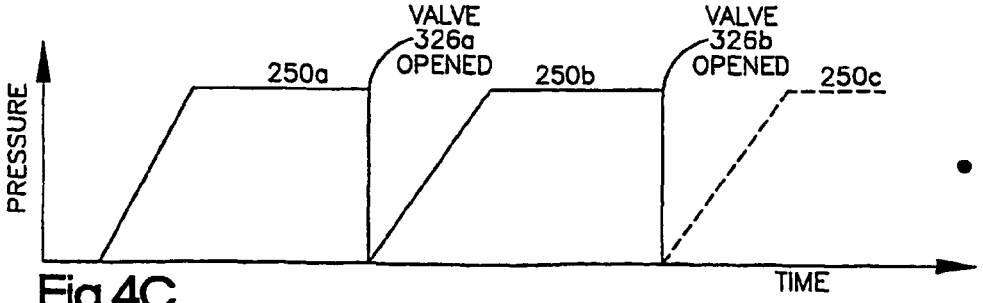

In a preferred embodiment, the solenoid drivers 332 may be controlled by, for example, the microcontroller 328, based on predetermined data as well as data provided by a user through the user input interface 330. The microcontroller 328 may be programmed to inflate the garment bladders 250 in such a manner that there is smooth transition from one bladder to the next during the massage process. For example, as illustrated in FIG. 4A, deflation of a first bladder 250A may be throttled so that inflation of a next bladder 250B is underway prior to complete deflation of the first bladder 250A. A similar wave effect may be accomplished without a throttled deflation, if, for example, the inflation of the next bladder begins earlier in the timing sequence, as illustrated in FIG. 4B. Alternatively, inflation of the next bladder 250B may be delayed until the first bladder 250A is completely deflated, as illustrated in FIG. 4C. Generally, the sequence of inflation will be in a venous direction. Alternatively, the sequence of inflation/deflation of the bladders may be bi-directional or random.

As shown in FIGS. 3B-3E, a user input interface 330 and user display 338 may be incorporated into a display panel 360. The display panel 360 may include a zone selector 362 which allows a user to select a certain zone of massage by the inflatable garment 200. This zone selection may result in concentration of the massage on a particular zone of the user's body, such as, for example, the foot ("Massage Zone 1"), the lower calf ("Massage Zone 2"), the upper calf ("Massage Zone 3"), or any combination of the foregoing zones. In the illustrated embodiment, for example, the garment bladders 250A-250D are grouped in a first "foot" massage zone, the garment bladders 250E-250H are grouped in a second "lower calf" massage zone, and the garment bladders 2501-250L are grouped in a third "upper calf" massage zone. Thus, a display panel 360 as illustrated allows the user to select a pre-determined massage zone. However, an inflation assembly 300 wherein user-definable zones may be input are possible with, and contemplated by, the present invention.

The display panel 360 may additionally include a massage program selector 364, a time selector 366, a power switch 368, an intensity selector (not shown) and/or a speed selector (not shown). The power switch 368 may be selected by a user to activate or deactivate the power supply 340. The massage program selector 364 allows a user to input an intensity setting in a range of the interrelation between speed and pressure. In addition or in the alternative, there may be separate intensity and/or speed selectors which allow the user to select an intensity level independent of selecting a speed level and vice versa. The intensity, speed and/or massage program setting(s) may be provided to the microcontroller 328 which controls the solenoid drivers 332. For example, a selected value of the massage program selector 364 may result in a massage with an inverse relationship between pressure and speed within the massage pressure wave (as illustrated at 364 in FIG. 3E). Thus, in such an example, the faster the massage pressure wave travels, the lower the applied pressure within the massage pressure wave and vice versa.

Figure 3E:
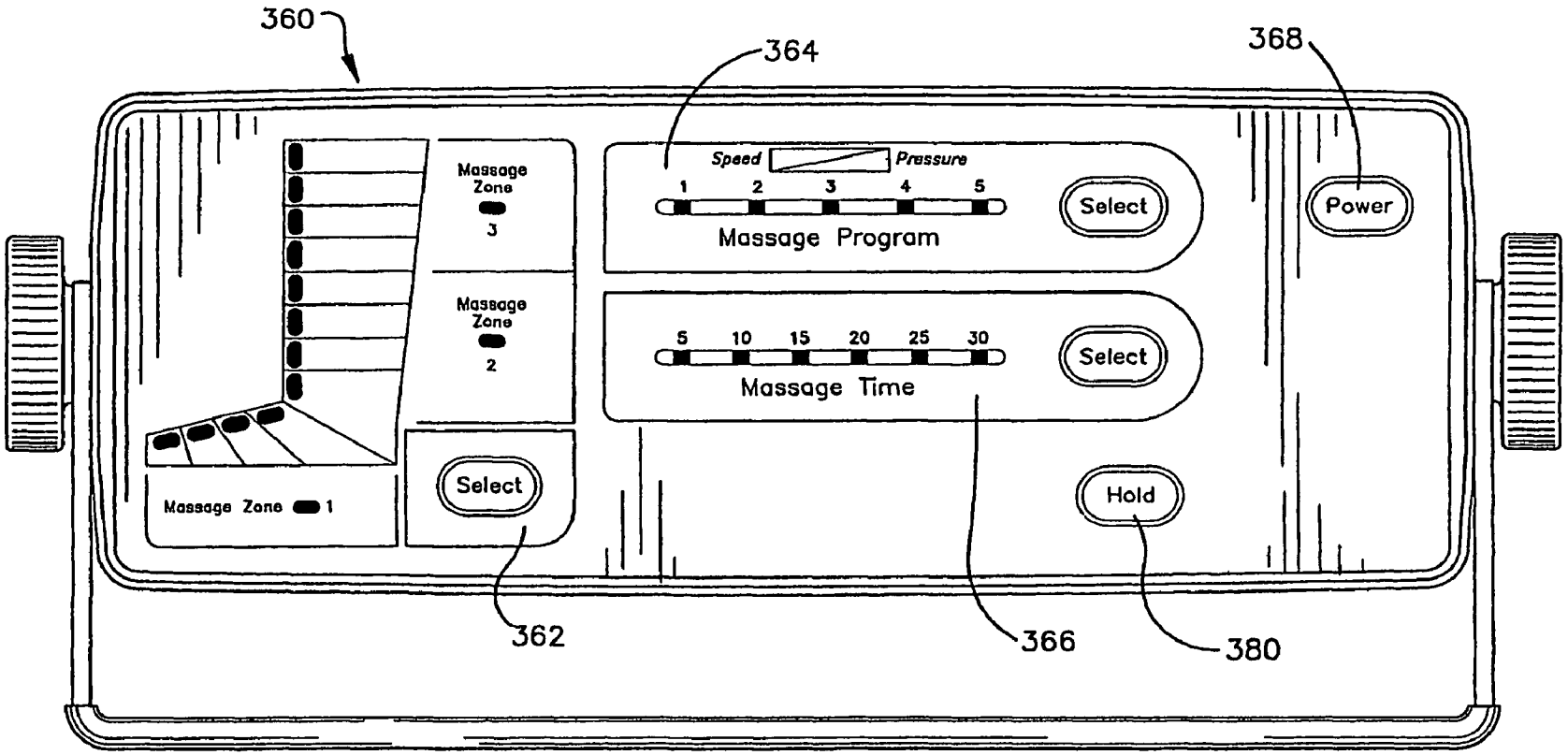
FIG. 3E is a front view of the display panel of the inflation assembly of FIG. 5B.

Via the time selector 366, a user may select a length of time for the massage session, and this selection is then provided to the microcontroller 328. The time selector 366 may include an uppermost setting, a lowermost setting, and a number of settings in between at multiples of, for example, 5 minutes (as shown in FIG. 3E). Alternatively, the massage time selector 366 may provide a keypad for the user to input a specific desired number of minutes. Upon completion of a timed massage session, an audio and/or visual alert 336 may alert the user of the end of the massage session. In addition or in the alternative, upon completion of the timed massage session, the inflation assembly 300 may automatically shut off.

In one embodiment of the invention, the speed, intensity and zone(s) settings may provide progressive or programmed massages where, for example, massage speed gradually changes from high speed to low speed and then back to high speed. As another example, the applied pressure may gradually change from low intensity to high intensity and then back to low intensity. As a third example, alternate massage modes may progress through various massage zones during the massage sample. In such a program, the massage may start out massaging the foot for a predetermined period of time, and then switch to the calf for the remainder of the massage session. As a fourth example, an external control source, such as an audio input, may be provided for pressure modulation in response to, for example, music or some other rhythmic or random pattern. As explained previously, these progressive modes may be stored in a memory unit for future recall and use.

In one embodiment of the invention, the display panel 360 or other suitable component of the massage device 100 may include a hold input 380. The hold input 380 may be used to provide continuous pressure (or continuous pulsating pressure) in a selected bladder or bladders upon activation by the user (e.g., pressing the "hold" key once), thereby providing concentrated action on a particular portion of the body. If the user wants to return to the previous or to "normal" operation, the "hold" key may be pressed again to do so. In addition or alternatively, the sequencing may return to the previous or to "normal" operation after a predetermined period of time after activation of the hold input 380.

Figure 3F:
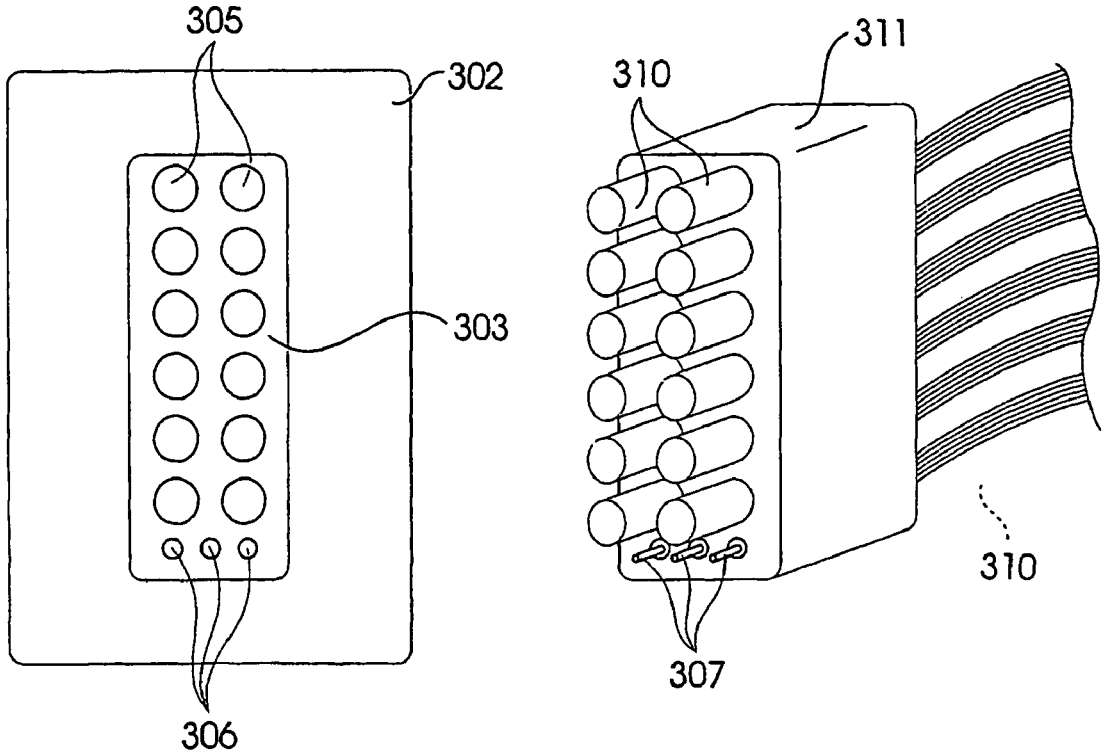
FIG. 3F illustrates a connector and a corresponding mating portion of the inflation assembly.
Figure 3G:
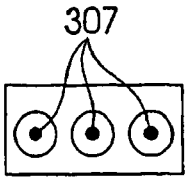
FIGS. 3G-3M are schematic views of different identifying patterns of garment identifying posts and corresponding openings of an inflation assembly.
Figure 3H:
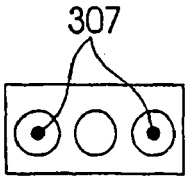
Figure 3I:
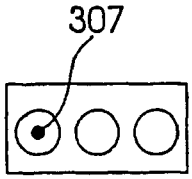
Figure 3J:
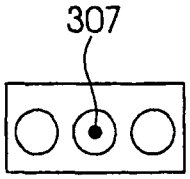
Figure 3K:
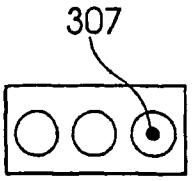
Figure 3L:
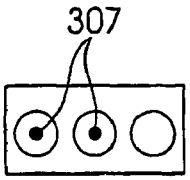
Figure 3M:
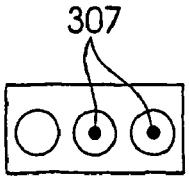

Referring now to FIG. 3F, a female connector portion 303 of the housing 302, and a corresponding male connector 311 are shown. The female connector portion 303 of the housing 302 may include a number of tube accommodating openings 305 to accommodate the tubes 310 from the connector 311. In addition, the female connector portion 303 may include a number of garment-identifying openings 306 (also referred to as "identifier openings") which may be used to accommodate identifier posts 307 which may function to recognize the particular inflatable garment being used upon insertion of the connector 311 into the housing 302.

The garment-identifying openings 306 may receive a certain number of identifier posts 307 on the connector 311 and, depending on the positioning of the posts received, the inflation assembly 300 may automatically identify the particular garment (e.g., hands, arm, neck/shoulder, foot/calf, thigh, etc.) associated with the inserted connector 311. Different identifying patterns are shown in FIGS. 3G-3M, corresponding respectively to different inflatable garments 200. For example, the pattern illustrated in FIG. 3G may correspond to the neck/shoulder garment 1200 shown in FIG. 2D, the pattern illustrated in FIG. 3H may correspond to the back garment 2200 shown in FIG. 2E, the pattern illustrated in FIG. 3I may correspond to may correspond to the hand garments 3200 shown in FIG. 2F, the pattern illustrated in FIG. 3J may correspond to the feet garments 4200 shown in FIG. 2G, the pattern illustrated in FIG. 3K may correspond to the arm garment 5200 shown in FIG. 2H, the pattern illustrated in FIG. 3L may correspond to the thigh garment 6200 shown in FIG. 21, and the pattern illustrated in FIG. 3M may correspond to the foot/calf garment 200 shown in FIG. 2A.

Although the embodiment illustrated in FIGS. 3F-3M includes up to three garment-identifying posts 307 and three corresponding identifier openings 306, more or less posts 307 and openings 306 may be used. For example, more posts/openings would provide for a greater number of identification patterns than those discussed above. Furthermore, encoding mechanisms other than posts and/or openings are certainty possible with and contemplated by the present invention.

As described herein, the same inflation assembly 300 can accommodate different garments without any further modifications made thereto. This compatibility provides manufacturing ease in that only one inflation assembly 300 need be designed for a plurality of different garments. Also, a purchaser can buy the inflation assembly 300 and perhaps one garment and then later purchase other garments for use with the inflation assembly 300.

Figure 3N:
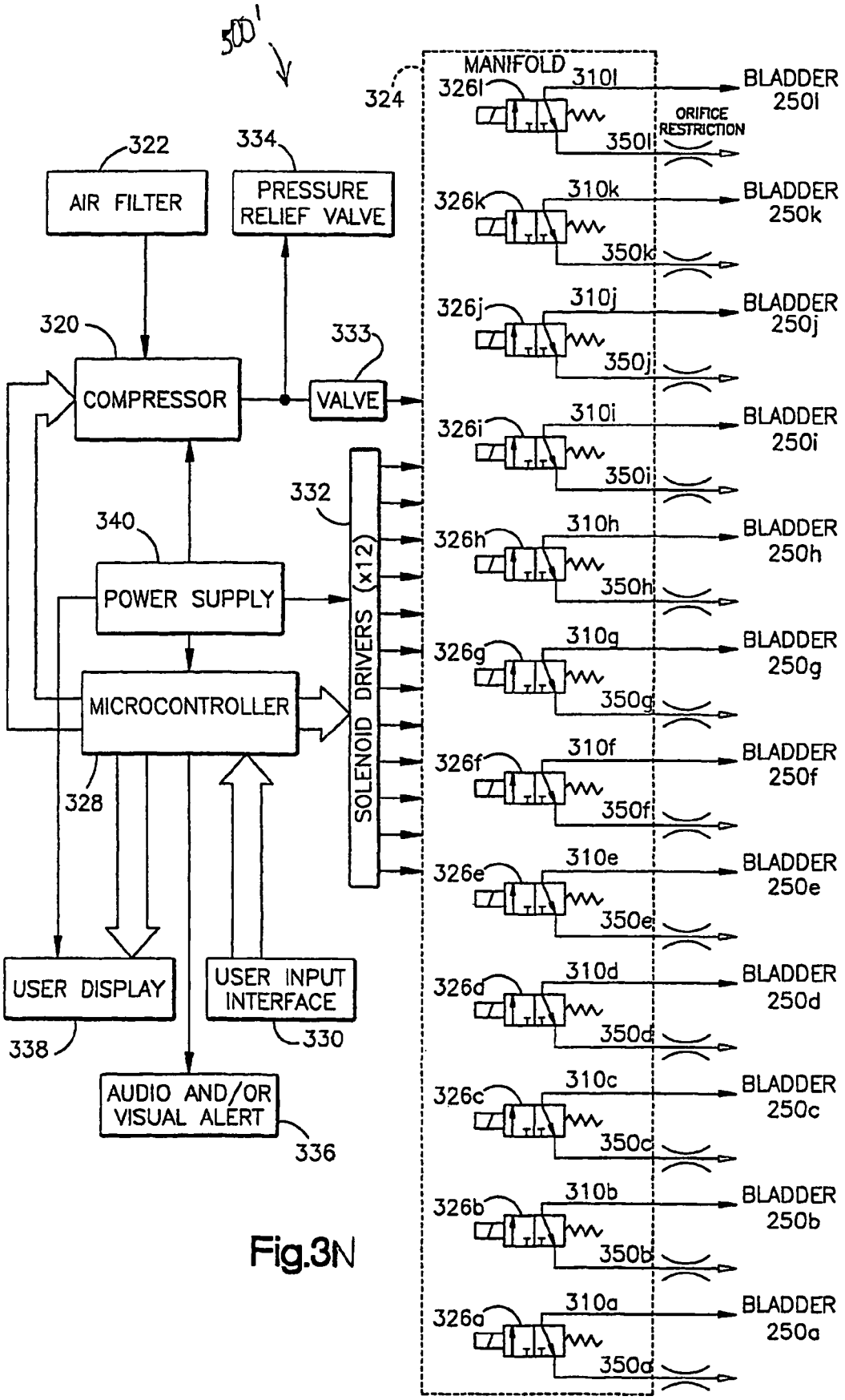
FIG. 3N is a schematic view of a modified form of the inflation assembly of FIG. 3B.

A modified form of the inflation assembly 300' is shown in FIG. 3N. This inflation assembly 300', like the inflation assembly 300 of FIG. 3B, may include a compressor 320, an air filter 322 (when air is used as the pressurizing medium), a manifold 324, valves 326A-326L, a microcontroller 328, user input interface 330, valve drivers 332, a pressure relief valve 334, audio and/or visual alert 336, a display panel 338, and a power supply 340 for providing power to relevant components, which can be the same or similar to the components of the assembly 300.

In addition, the inflation assembly 300' may include a manifold valve 333 positioned upstream of the bladder valves 326A-326L which is switched (by the microcontroller 328) between an open position and a closed position. In an open position, flow of the inflation fluid from the compressor 320 to the manifold 324 is permitted (as in the inflation assembly 300 without the manifold valve 333) and, in the closed position, flow from the compressor 320 to the manifold 324 is prohibited. In either case, the pressure relief valve 334 limits the maximum pressure that can be developed in the manifold and therefore delivered to the garment 200.

The manifold valve 333 is used to control the maximum massaging pressure level reached in the bladders 250 during the massage process. Without this valve 333, the maximum massaging pressure level reached in the bladders is generally substantially the same (see, e.g., FIGS. 4A-4C) or may generally only be altered by shortening the amount of time during which the bladder is being inflated (referred to as the "inflation interval") by closing the respective solenoid valve 326.

Figure 4D:
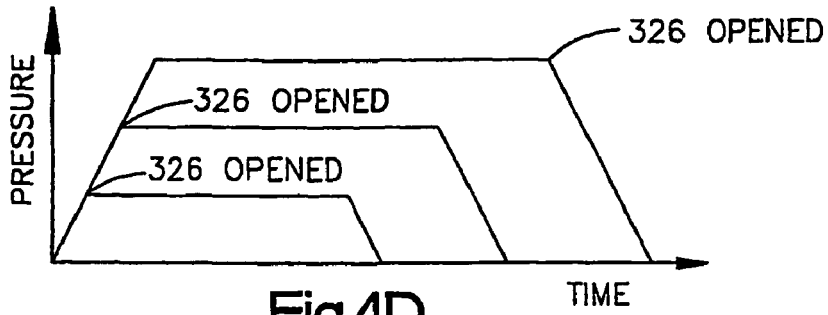
Figure 4E:
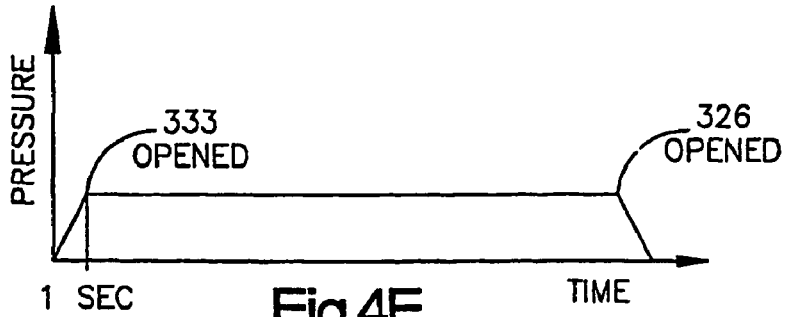
Figure 4F:
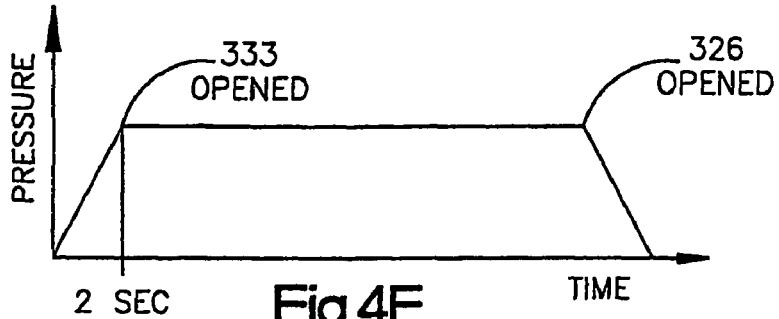
Figure 4G:
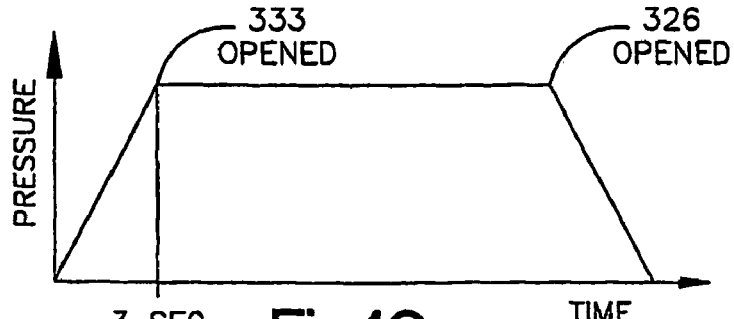
Figure 5A:
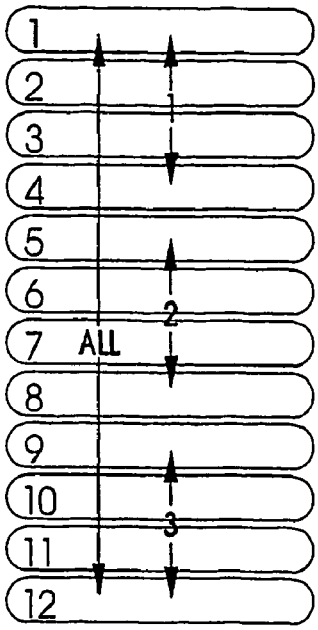
FIGS. 5A-5G are schematic views of possible bladder arrays for garment design in accordance with the invention.
Figure 5B:
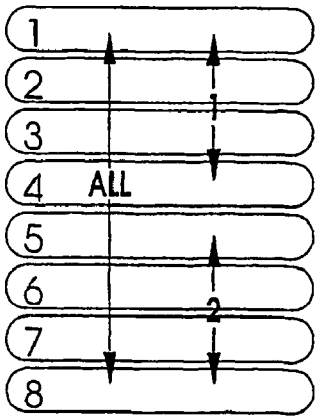
Figure 5C:
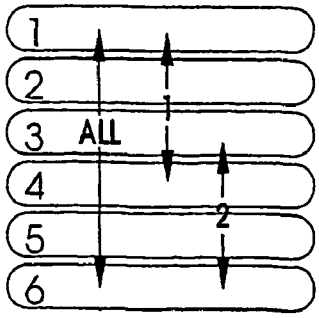
Figure 5D:
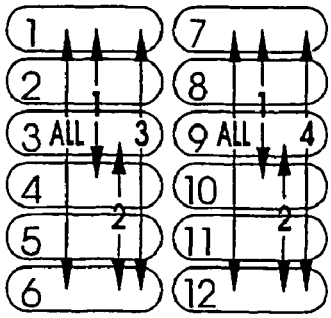
Figure 5E:
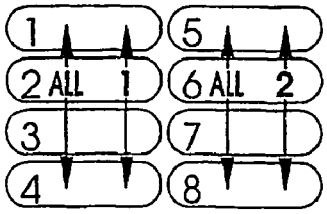
Figure 5F:
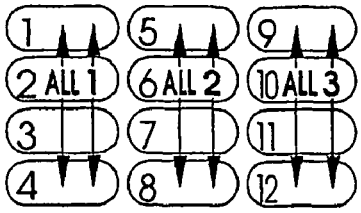
Figure 5G:
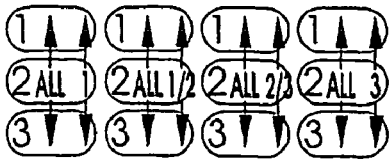

(See FIG. 4D.) By closing the valve 333 at different intervals (e.g., 1, 2 or 3 seconds) the maximum pressure level may be controlled without decreasing the inflation interval of the bladder (see e.g., FIGS. 4E, 4F, and 4G). Thus, the maximum pressure level in a bladder may be controlled by the manifold valve 333 while the inflation interval is controlled by a respective solenoid valve 326.

The minimum capacity of the compressor 320 is generally defined by the largest individual bladder size that needs to be inflated during the desired massage process. Accordingly, if a garment is designed for use with an existing inflation assembly 300/300', the garment design may be limited to using individual bladders (or combinations of simultaneously inflated sub-bladders) that do not exceed the capacity of the compressor.

For example, assume that the maximum bladder volume that can be inflated simultaneously is 180 $cm^3$ (e.g., one 180 $cm^3$ bladder, two 90 $cm^3$ sub-bladders, three 60 $cm^3$ sub bladders, four 45 $cm^3$ sub bladders, etc.) and the maximum number of bladders is twelve. With these specifications, standard bladder arrays may be defined such as, for example, the sample arrays illustrated in FIGS. 5A-5G, which may be implemented in various inflatable garment designs. The sample arrays may have, for example, the following characteristics:

| Array Size | Bladder Size ($cm^3$) | Inflation Time* (sec) | Cycle Time** (sec) |
|---|---|---|---|
| 12 × 1 | 180 | 2.70 | 32.4 |
| 8 × 1 | 180 | 2.70 | 21.6 |
| 6 × 1 | 180 | 2.70 | 16.2 |
| 6 × 2 | 90 | 1.35 | 16.2 |
| 4 × 2 | 90 | 1.35 | 10.8 |
| 4 × 3 | 60 | 0.90 | 10.8 |
| 4 × 4 | 45 | 0.45 | 5.4 |

*per bladder with a compressor having a 4 lpm flow rate.
**through each array when all massage zones are selected.

As explained above, an inflation assembly 300/300' may incorporate a "speed of massage control" that controls the rate of movement of the pressure wave through the garment. In a constant flow capacity system, this would generally function as a speed/pressure control where the speed and pressure are related. As is generally true with most human-provided massages, the faster the massaging action, the lower the pressure and the slower the massaging action the higher the pressure. Exemplary settings and corresponding specifications for such a control are set forth below:

| | Time | Air Flow | Percent Inflation of Bladder | | | |
|---|---|---|---|---|---|---|
| Setting | (sec) | ($cm^3$) | 180 $cm^3$ | 90 $cm^3$ | 60 $cm^3$ | 45 $cm^3$ |
| 1 | 0.30 | 20 | 11 | 22 | 33 | 44 |
| 2 | 0.60 | 40 | 22 | 44 | 67 | 89 |
| 3 | 0.90 | 60 | 33 | 67 | 100 | 100 |
| 4 | 1.20 | 80 | 44 | 89 | 100 | 100 |
| 5 | 1.50 | 100 | 56 | 100 | 100 | 100 |

-continued

| | Time | Air Flow | Percent Inflation of Bladder | | | |
|---|---|---|---|---|---|---|
| Setting | (sec) | ($cm^3$) | 180 $cm^3$ | 90 $cm^3$ | 60 $cm^3$ | 45 $cm^3$ |
| 6 | 1.80 | 120 | 67 | 100 | 100 | 100 |
| 7 | 2.10 | 140 | 78 | 100 | 100 | 100 |
| 8 | 2.40 | 160 | 89 | 100 | 100 | 100 |
| 9 | 2.70 | 180 | 100 | 100 | 100 | 100 |
| 10 | 3.00 | 200 | 100 | 100 | 100 | 100 |

The time value represents the inflation interval of the bladders during the massage sequence. Depending on the garment or attachment used with the controller (the size and array of the bladders used) some of these settings will provide a satisfactory massaging action, while others may be too slow or too fast. For example, a foot/calf inflatable garment with all zones enabled may work best in settings 4-10, whereas settings 1-3 may uncomfortably develop pressure quickly in the bladders. When only one or two zones of the same garment are selected then the faster settings may be preferred, while the higher (slower) settings might be too slow or too hard.

More or less settings can be used to accommodate different types of garments. Also, although the exemplary tables reflects a linear relationship between setting and time, other relationships are possible with and contemplated by the present invention. Each control setting can reference a time value that is a better match for that part of the range.

One may further appreciate that although the invention has been shown and described with respect to a certain preferred embodiment, obvious and/or equivalent alterations and modifications will occur to others skilled in the art upon the reading and understanding of this specification. The present invention includes all equivalent alterations and modifications and is limited only by the scope of the following claims.

What is claimed is:

1. A massage device for use in an unsupervised and unattended setting, the massage device comprising:

an inflatable garment having a plurality of inflatable bladders, wherein the inflatable garment is shaped to accommodate a back and shoulder portion of a user and includes a central opening to accommodate a neck of the user and wherein the inflatable bladders are located in at least a back portion and a shoulder portion of the inflatable garment and wherein the inflatable garment further includes a plurality of inserts adjacent to the user's neck to form a raised neckline, and an elastic material along longitudinal edges of the garment, and an inflation assembly for supplying the pressurized fluid to each of the inflatable bladders.

2. A massage device as set forth in claim 1, wherein the inflatable garment further includes a pressure plate generally shaped to contour the back and shoulder portion, and straps to assist in holding the pressure plate in place.

3. A massage device as set forth in claim 1, wherein the plurality of inserts includes at least one tab formed in the central opening to form the raised neckline in a neck region of a user.

* * * * *